US009651913B2

(12) United States Patent
Koshida

(10) Patent No.: US 9,651,913 B2
(45) Date of Patent: May 16, 2017

(54) IMAGE FORMING APPARATUS HAVING A HOLDER THAT MOVES RELATIVE TO AN OPENING/CLOSING DOOR

(71) Applicant: CANON KABUSHIKI KAISHA, Tokyo (JP)

(72) Inventor: Kohei Koshida, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/088,152

(22) Filed: Nov. 22, 2013

(65) Prior Publication Data

US 2014/0147183 A1 May 29, 2014

(30) Foreign Application Priority Data

Nov. 26, 2012 (JP) ..... 2012-257501

(51) Int. Cl.
*G03G 21/16* (2006.01)
*G03G 15/00* (2006.01)
(Continued)

(52) U.S. Cl.
CPC ..... *G03G 15/657* (2013.01); *B65H 29/52* (2013.01); *B65H 43/00* (2013.01); *G03G 15/6573* (2013.01); *G03G 21/1633* (2013.01); *B65H 2402/441* (2013.01); *B65H 2402/45* (2013.01); *B65H 2511/112* (2013.01); *B65H 2511/51* (2013.01); *B65H 2553/612* (2013.01); *B65H 2553/81* (2013.01); *B65H 2601/11* (2013.01);
(Continued)

(58) Field of Classification Search
CPC ..... B65H 2553/81; B65H 2511/112; B65H 2402/441; B65H 2402/45; B65H 2553/612; G03G 15/657; G03G 15/6573; G03G 2215/00594; G03G 2215/00628
See application file for complete search history.

(56) References Cited

U.S. PATENT DOCUMENTS 6,678,487 B2 * 1/2004 Tashiro ..... G03G 15/00 399/107
7,526,214 B2 * 4/2009 Asaba ..... G03G 15/70 399/18
(Continued)

FOREIGN PATENT DOCUMENTS

CN 1841237 A 10/2006
CN 101293600 A 10/2008
(Continued)

*Primary Examiner* — Justin Olamit
(74) *Attorney, Agent, or Firm* — Canon USA, Inc. IP Division

(57) ABSTRACT

A sheet conveyance apparatus includes an apparatus main body, an opening/closing door movably supported by the apparatus main body so as to be capable of opening a conveyance path through which a sheet is conveyed, a sensor lever configured to rotate when pushed by the sheet in the conveyance path, a holder rotatably holding the sensor lever and movably supported by the opening/closing door, a positioning portion provided in the apparatus main body and configured to perform positioning of the holder by coming into contact with the holder, and a sheet detection sensor provided in the apparatus main body and configured to generate a signal corresponding to the position of the sensor lever.

20 Claims, 19 Drawing Sheets

(51) Int. Cl.
*B65H 29/52* (2006.01)
*B65H 43/00* (2006.01)

(52) U.S. Cl.
CPC ..... *B65H 2801/06* (2013.01); *G03G 15/70* (2013.01); *G03G 15/80* (2013.01); *G03G 21/1652* (2013.01); *G03G 2215/00544* (2013.01); *G03G 2215/00628* (2013.01)

(56) References Cited

U.S. PATENT DOCUMENTS

| | | | | |
|---|---|---|---|---|
| 7,900,909 | B2 * | 3/2011 | Hiura et al. | 271/122 |
| 2007/0264033 | A1 * | 11/2007 | Koshida | 399/16 |
| 2009/0162121 | A1 * | 6/2009 | Kitan | 399/400 |
| 2012/0207486 | A1 * | 8/2012 | Egawa et al. | 399/21 |

FOREIGN PATENT DOCUMENTS

| | | | |
|---|---|---|---|
| CN | 101354565 | A | 1/2009 |
| CN | 101470369 | A | 7/2009 |
| JP | H02-248964 | A | 10/1990 |
| JP | 2006-072253 | A | 3/2006 |
| JP | 2008-070522 | A | 3/2008 |
| JP | 2008-158076 | A | 7/2008 |
| JP | 2013-114146 | A | 6/2013 |

* cited by examiner

IMAGE FORMING APPARATUS HAVING A HOLDER THAT MOVES RELATIVE TO AN OPENING/CLOSING DOOR

BACKGROUND OF THE INVENTION

Field of the Invention

The present invention relates to an image forming apparatus configured to form an image on a sheet.

Description of the Related Art

An image forming apparatus employing electrophotography develops a latent image formed on a photosensitive drum into a visible image. This visible image (toner image) is transferred onto a sheet at a transfer unit by using an electrostatic force. Then, the image transferred onto the sheet is fixed to the sheet by heat at a fixing unit, whereby an image is formed on the sheet.

In the image forming apparatus, there is provided a sheet detection unit for detecting the sheet conveyance timing inside the image forming apparatus and the conveyance attitude. For example, to stabilize the sheet conveyance between the transfer unit and the fixing unit, there is arranged, between the transfer unit and the fixing unit, a loop detection unit for detecting the loop amount of a sheet (See Japanese Patent Application Laid-Open No. 2006-072253). The loop detection unit is composed of a loop detection lever configured to rotate when pushed by a sheet, and a loop detection sensor (photo interrupter) configured to generate a signal corresponding to the position of the loop detection lever. Based on a signal from the loop detection sensor, speed control is performed at the fixing unit so that the attitude of the sheet may be stabilized. A loop sensor lever directly contacting the sheet is arranged so as to be held in contact with the non-image surface of the sheet. This is due to the fact that, if the loop sensor comes into contact with the image surface side, the unfixed toner image will be disturbed by the loop sensor lever.

Another example of the sheet detection unit, a detection lever of a post-fixing detection sensor provided on the downstream side of the fixing unit is also arranged so as to be in contact with the non-image surface of the sheet. This arrangement is made for the purpose of preventing the toner image from being disturbed by the detection lever.

In this context, there exists an apparatus equipped with a door that can be opened and closed with respect to an apparatus main body provided with a detection sensor, and a sensor lever is rotatably mounted on the door (Japanese Patent Application Laid-Open No. 2008-70522 and Japanese Patent Application Laid-Open No. 2-248964). With this configuration, the detection accuracy depends on variation in the position of the door when it is closed (the relative position thereof with respect to the apparatus main body).

SUMMARY OF THE INVENTION

The present invention is directed to an image forming apparatus capable of performing detection with high precision.

According to an aspect of the present invention, a sheet conveyance apparatus includes: an apparatus main body; an opening/closing door movably supported by the apparatus main body so as to be capable of opening a conveyance path through which a sheet is conveyed; a sensor lever configured to rotate when pushed by the sheet in the conveyance path; a holder rotatably supporting the sensor lever and movably supported by the opening/closing door; a positioning portion provided in the apparatus main body and configured to effect positioning on the holder by coming into contact with the holder; and a sheet detection sensor provided in the apparatus main body and configured to generate a signal corresponding to the position of the sensor lever.

Further features of the present invention will become apparent from the following description of exemplary embodiments with reference to the attached drawings.

DESCRIPTION OF THE EMBODIMENTS

An image forming apparatus according to a first exemplary embodiment of the present invention will be described.

<Overall Configuration of the Image Forming Apparatus>

Figure 1:
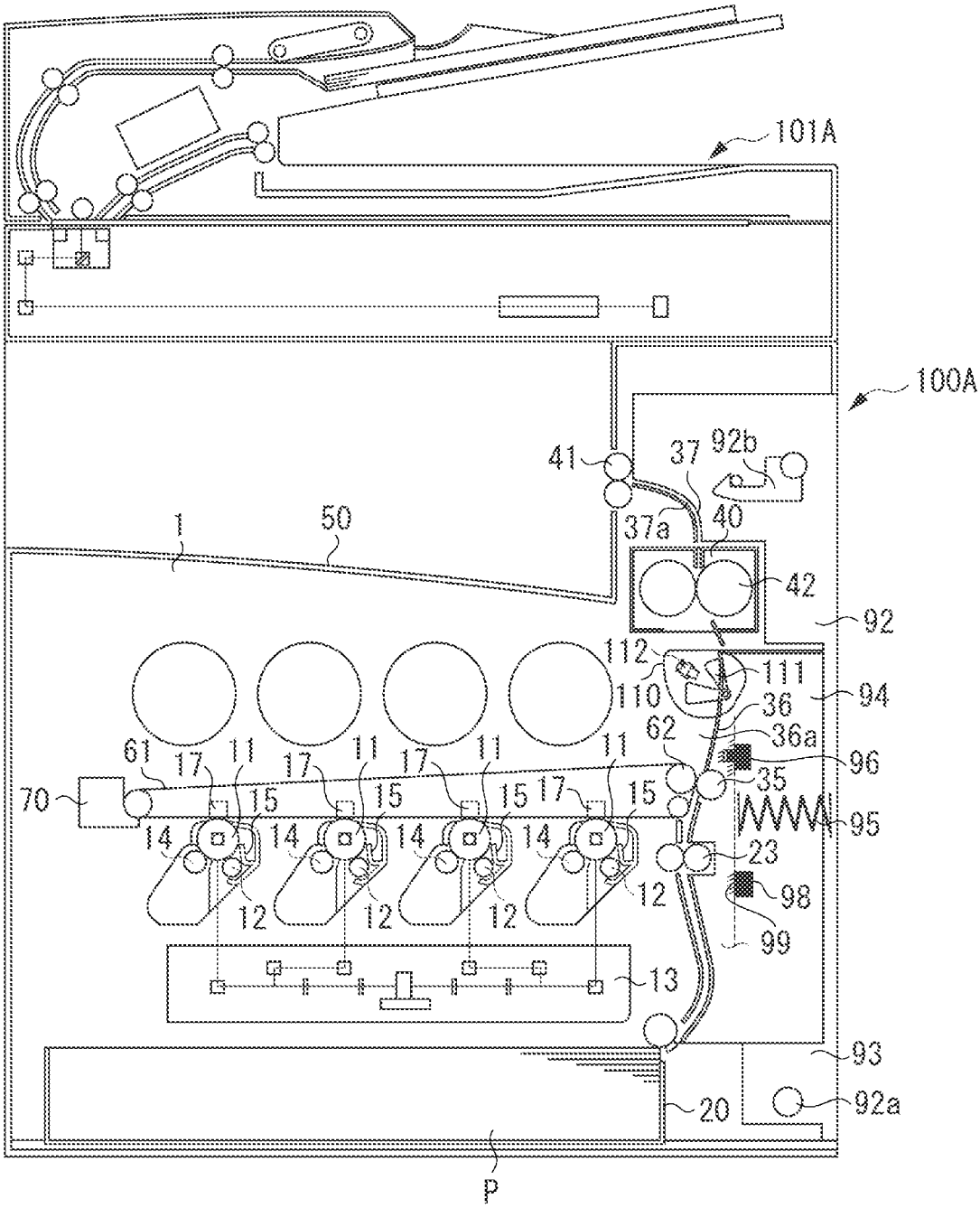
FIG. 1 is a sectional view of an image forming apparatus according to a first exemplary embodiment.

FIG. 1 is a sectional view of the image forming apparatus according to the first exemplary embodiment.

The image forming apparatus is composed of an image reading unit 101A configured to read the image of a document, and a printer unit 100A configured to form an image on a sheet.

The printer unit 100A is equipped with image forming units of yellow (Y), magenta (M), cyan (C), and black (Bk) colors. The surfaces of photosensitive drums 11 are uniformly charged by charging rollers 12. After charging, a latent image is formed on the surface of each photosensitive drum 11 by a laser scanner 13 driven based on image information transmitted or an image signal of image information read by an image reading unit 101A. The latent image is made visible as a toner image by a developing device 14. The toner images on the photosensitive drums 11 of the image forming units of the different colors are successively transferred to an intermediate transfer belt 61 constituting an image bearing member by imparting a predetermined pressing force and an electrostatic load bias to the toner images by primary transfer rollers 17. A slight amount of residual toner remaining on the photosensitive drums 11 is removed and collected by photosensitive drum cleaning units 15.

On the other hand, sheets P are fed one by one from a feeding cassette 20, and conveyed to a registration roller pair 23. In synchronism with the toner images on the intermediate transfer belt 61, the registration roller pair 23 conveys each sheet P between a transfer drive roller 62 for driving the intermediate transfer belt 61 and a secondary transfer roller 35 serving as a transfer unit.

The color toner image on the intermediate transfer belt 61 is transferred to the sheet P by applying a predetermined pressing force and an electrostatic load bias thereto at a nip portion (transfer portion) formed by the transfer drive roller 62 and the secondary transfer roller 35. The slight amount of residual toner remaining on the intermediate transfer belt 61 is removed and collected by a cleaning unit 70.

The sheet to which the toner image has been transferred by the transfer unit (62, 35) passes through a conveyance path 36*a*, and conveyed to a fixing device 40. Between the transfer unit (62, 35) and the fixing device 40, there is provided a conveyance guide 36 to form the conveyance path 36*a*. The fixing device 40 as the fixing unit heats and presses the toner image on the sheet while conveying the sheet, whereby the toner image is fixed to the sheet. The sheet having passed the fixing device 40 is discharged onto a discharge tray 50 by a discharge roller pair 41 via a post-fixing conveyance path 37*a*. Between the fixing device 40 and the discharge roller pair 41, there is arranged a conveyance guide 37 to form the post-fixing conveyance path 37*a*.

<Opening/Closing Door>

Figure 2:
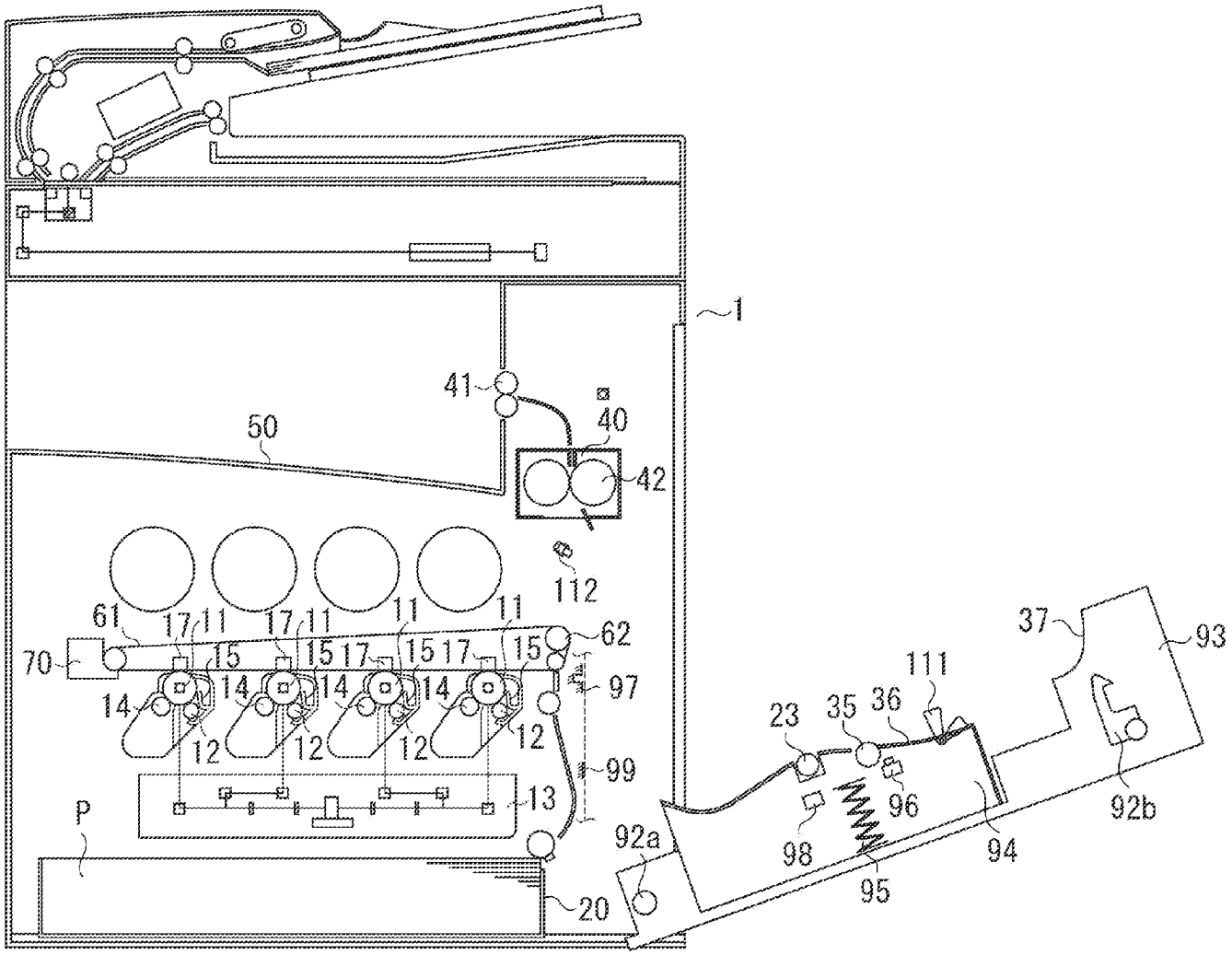
FIG. 2 is a sectional view illustrating a state in which an opening/closing door is open according to the first exemplary embodiment.

An opening/closing door 92 will be described with reference to FIG. 1, which illustrates a state in which the opening/closing door 92 is closed, and FIG. 2, which illustrates a state in which the opening/closing door 92 is open.

On the right-hand side of an apparatus main body 1 of a printer unit 100A including a sheet conveyance apparatus configured to convey sheets, there is movably provided the opening/closing door 92 so as to be capable of opening the conveyance path 36*a* and the post-fixing conveyance path 37*a*. To achieve a reduction in weight, the opening/closing door 92 is formed of resin. The opening/closing door 92 includes a door main body 93 rotatably supported by the apparatus main body 1 by a hinge shaft 92*a* provided on the lower portion of the printer unit 100A, and a movable unit 94 movably held by the door main body 93. On the upper portion of the door main body 93, there is provided a door lock portion 92*b* for locking the opening/closing door 92 in the closed state.

A compression spring 95 is provided between a movable unit 94 and the door main body 93. The movable unit 94 is held by the door main body 93 in a floating state to be movable in the vertical direction, the horizontal direction, and the front-back direction. One roller of the registration roller pair 23 and the secondary transfer roller 35 rotatably hold the movable unit 94. The movable unit 94 is equipped with a conveyance guide 36.

The movable unit 94 is equipped with a positioning protrusion 96. The positioning protrusion 96 is engaged with a positioning hole portion 97 (See FIG. 2) provided in the apparatus main body 1. The positioning protrusion 96 and the positioning hole portion 97 are provided outside the sheet conveyance region and on both sides in the horizontal direction of the movable unit 94. Further, the movable unit 94 is provided with an abutment portion 98 configured to abut an abutment portion 99 of the apparatus main body 1. The abutment portion 99 and the abutment portion 98 are provided outside the sheet conveyance region and on both sides in the horizontal direction of the movable unit 94.

When the sheet P is jammed during image formation, the user opens the sheet conveyance path including the conveyance path 36*a* and the post-fixing conveyance path 37*a* in order to remove the sheet P from the image forming apparatus. To open the conveyance path 36*a* and the post-fixing conveyance path 37*a*, the user first releases the lock by the door lock portion 92*b*. And, when the opening/closing door 92*a* is rotated around the hinge shaft 92*a* to open the opening/closing door 92*a* as illustrated in FIG. 2, the conveyance path 36*a* and the post-fixing conveyance path 37*a* are opened. The conveyance path 36*a* is provided with a loop detection unit described in detail below. When the opening/closing door 92 is closed, the positioning protrusion 96 is engaged with the positioning hole portion 97 of the apparatus main body 1, and the abutment portion 98 of the movable unit 94 and the abutment portion 99 of the apparatus main body 1 abut each other, whereby positioning is effected on the movable unit 94 with respect to the apparatus main body 1. In other words, in the process in which the opening/closing door 92 is closed, the positioning protrusion 96 is engaged with the positioning hole portion 97 of the apparatus main body 1, and the abutment portion 98 abuts the abutment portion 99 of the apparatus main body 1, whereby the movable unit 94 moves relative to the door main body 93 against the urging force of the compression spring to be set in position with respect to the apparatus main body 1. The distal end side portion of the positioning protrusion 96 is formed as a tapered portion, and, in the process in which the opening/closing door 92 is closed, the edge of the hole portion 97 comes into contact with the tapered portion, whereby positioning is effected on the movable unit 94 in the vertical direction and the longitudinal direction.

<Loop Detection Unit>

FIGS. 3A and 3B through 6 are explanatory views for illustrating a loop detection unit for detecting a sheet loop between the transfer unit (62, 35) and the fixing device 40.

Figure 3A:
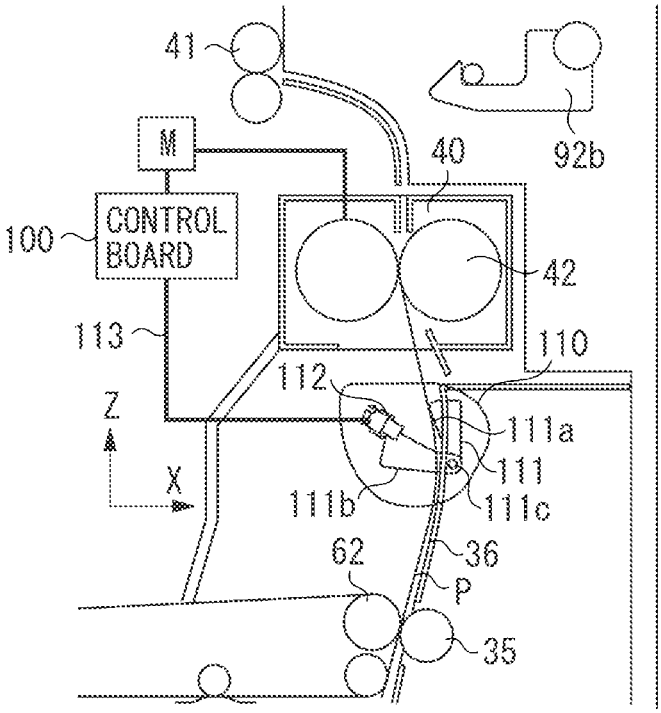
FIGS. 3A and 3B are explanatory views for illustrating a loop detection unit in the image forming apparatus according to the first exemplary embodiment.
Figure 3B:
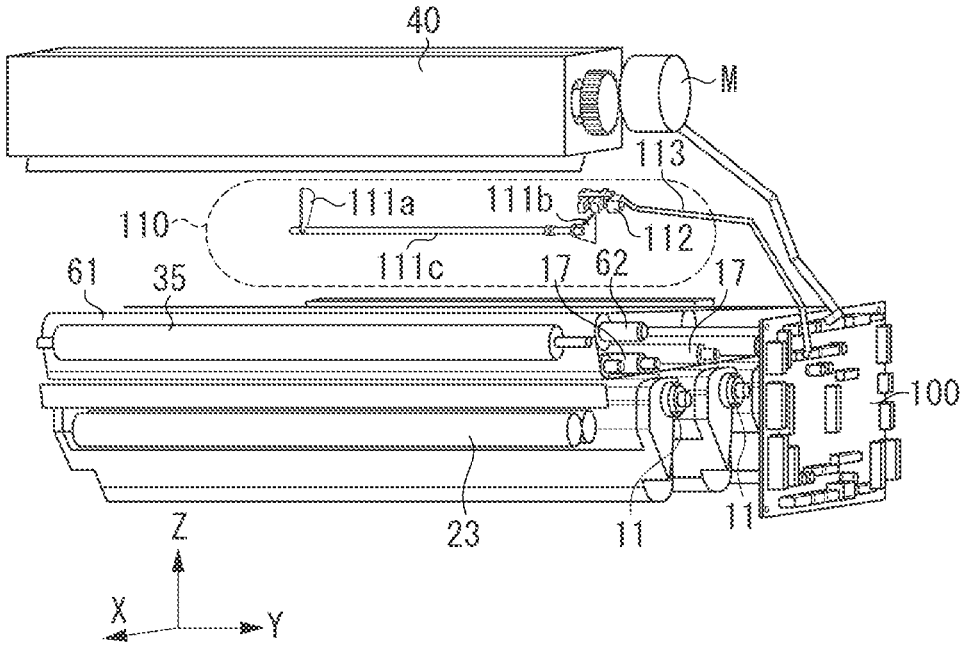
Figure 4:
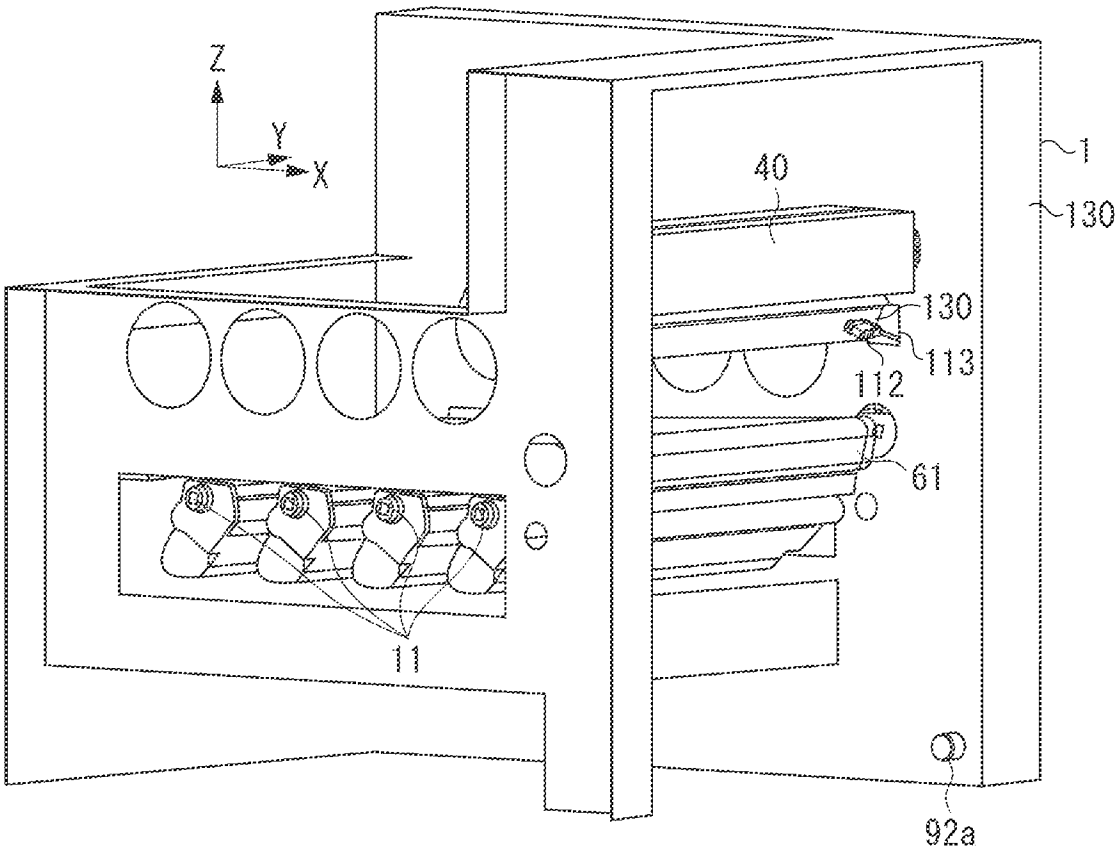
FIG. 4 is an explanatory view illustrating a loop detection sensor according to the first exemplary embodiment.

FIG. 3A is a front sectional view of the image forming apparatus, and FIG. 3B is a perspective view of the same as seen from the rear side. FIG. 4 is a perspective view of the image forming apparatus as seen obliquely from the front right side.

Figure 5A:
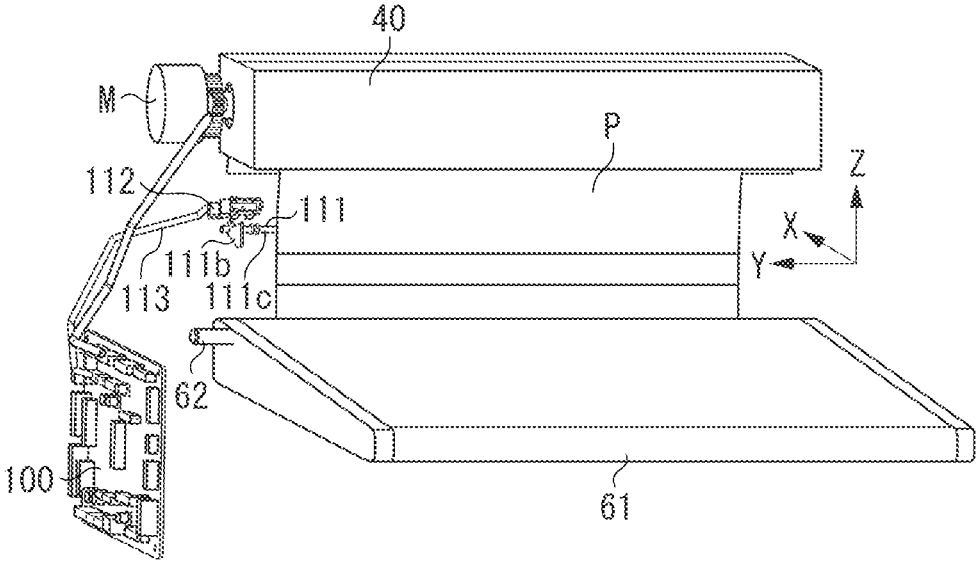
FIGS. 5A and 5B are explanatory views illustrating the loop detection sensor according to the first exemplary embodiment.
Figure 5B:
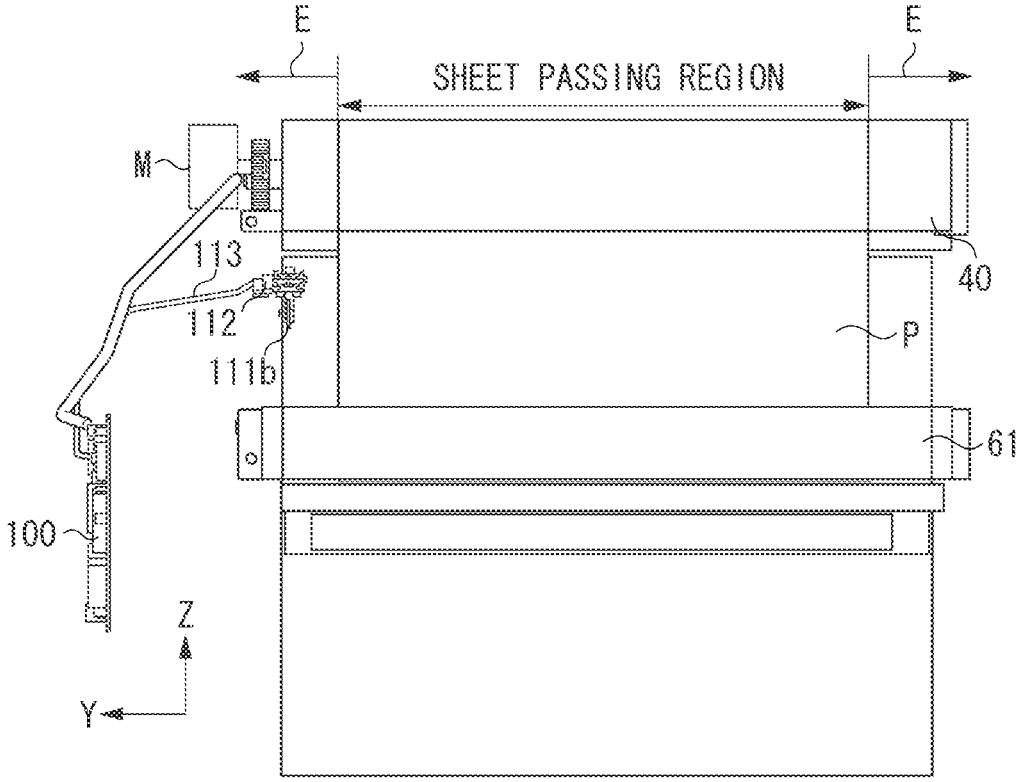
Figure 6:
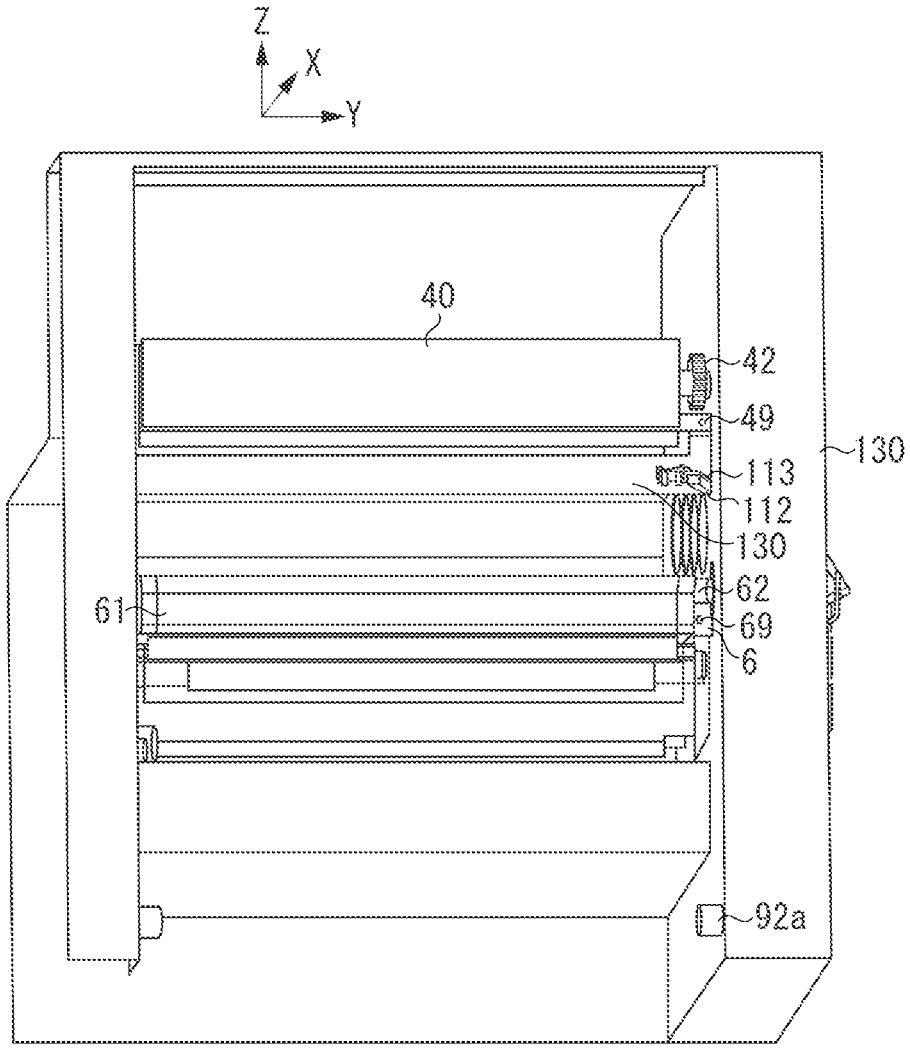
FIG. 6 is an explanatory view illustrating mounting of the loop detection sensor according to the first exemplary embodiment.

FIGS. 5A and 5B are diagrams illustrating the arrangement of the loop detection sensor. FIG. 5A is a perspective view, and FIG. 5B is a side view. FIG. 6 is an explanatory view illustrating mounting of the loop detection sensor.

Figure 7A:
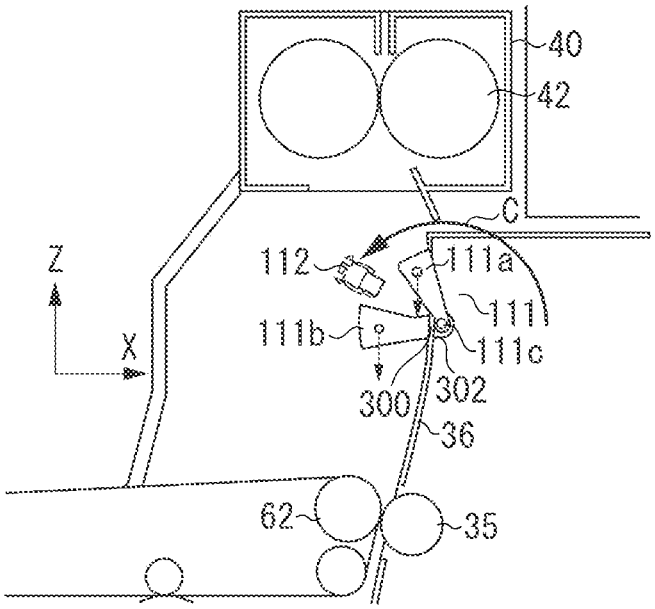
FIGS. 7A, 7B, and 7C are explanatory views illustrating a configuration of a sensor lever according to the first exemplary embodiment.
Figure 7B:
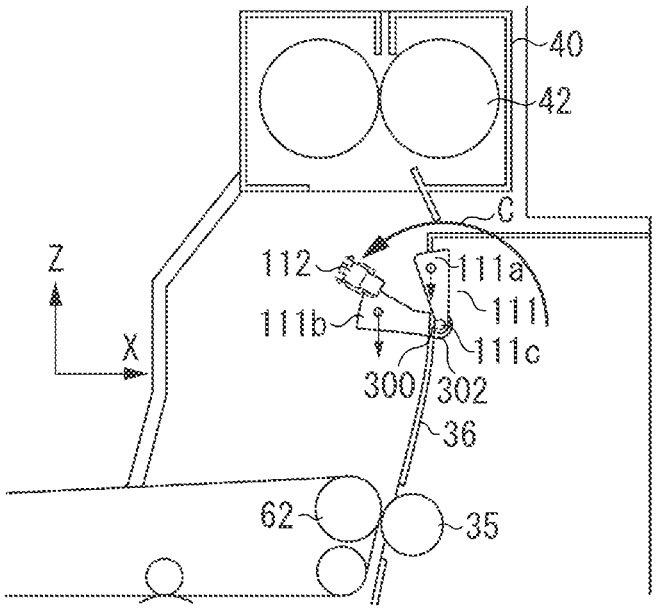
Figure 7C:
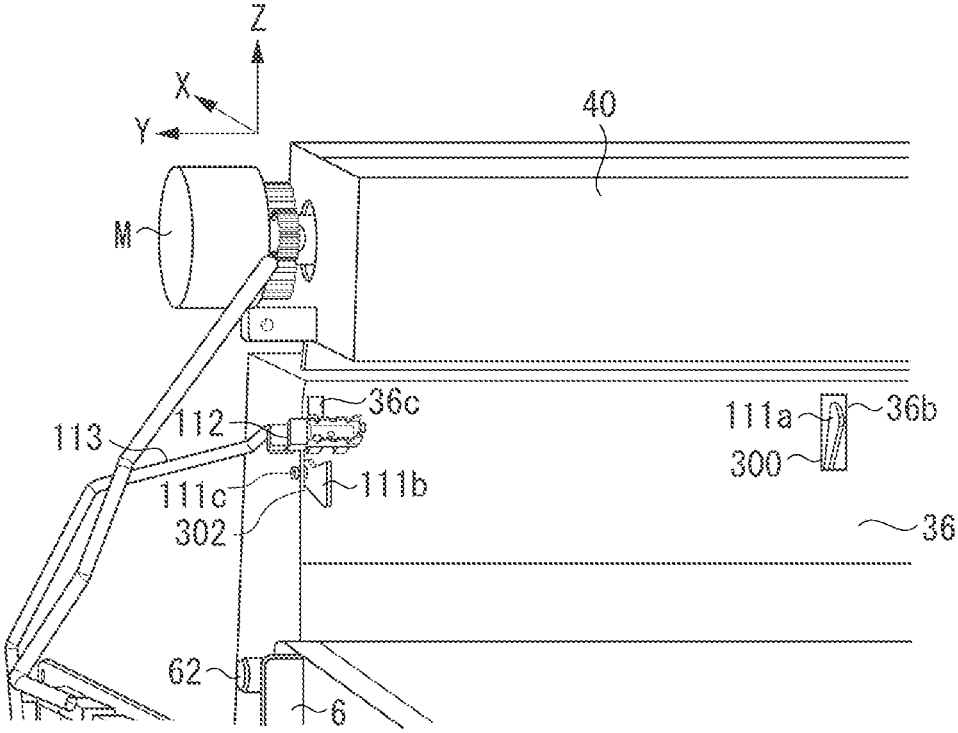

FIGS. 7A, 7B, and 7C are explanatory views illustrating a configuration of a sensor lever. FIG. 7A is a sectional view illustrating a state in which the rotation of the sensor lever is regulated and the sensor lever is being at rest. FIG. 7B is a sectional view illustrating a position of the sensor lever when loop control is being performed. FIG. 7C is a perspective view illustrating the state in which the rotation of the sensor lever is regulated and the sensor lever is being at rest.

As illustrated in FIG. 3A, the printer unit 100A is equipped with a loop detection unit 110 for detecting a sheet loop in the conveyance path 36*a* between the secondary transfer roller 35 and the fixing device 40.

The loop detection unit 110 is equipped with a sensor lever 111 configured to come into contact with the sheet P, and a loop detection sensor 112 serving as a sheet detection sensor configured to generate a signal corresponding to the position of the sensor lever 111.

As illustrated in FIG. 3B, which is a perspective view of the apparatus main body 1 as seen from the rear side, the sensor lever 111 is equipped with a horizontally extending rotation shaft 111*c*. Further, the sensor lever 111 has a sheet contact portion 111*a* radially protruding at one end of the rotation shaft 111*c* and configured to come into contact with the sheet that is being conveyed. Further, the sensor lever 111 is equipped with a light shielding portion 111*b* radially protruding at the other end of the rotation shaft 111*c* and facing the loop detection sensor 112. In the present exemplary embodiment, the loop detection sensor 112 is equipped with a light emitting portion configured to emit light and a light receiving portion configured to receive the light emitted by the light emitting portion, constituting a photo interrupter configured to generate a signal corresponding to the light reception amount. The light shielding portion 111*b* of the sensor lever 111 shields the optical path between the light emitting portion and the light receiving portion of the photo interrupter.

The sheet contact portion 111*a* abuts against the sheet pinched by both the transfer unit (62, 35) and the fixing device 40, to rotate the sensor lever 111. The light shielding portion 111*b* of the sensor lever 111 operates the loop detection sensor, whereby the loop detection sensor 112 outputs a signal corresponding to the size of the loop formed in the sheet.

The signal from the loop detection sensor 112 is input to a control board 100 as a control unit (See FIG. 3B) via a line bundle 113 as a signal transmission member. The control board 100 controls a fixing motor M for driving the fixing device 40 constituting the sheet conveyance unit to change the sheet conveyance speed of the fixing device 40.

That is, the rotation control of the fixing motor M is performed by the control board 100 based on the signal from the loop detection sensor, whereby the sheet conveyance attitude between the transfer unit (62, 35) and the fixing device 40 is stabilized. More specifically, when a signal indicating that the sheet loop amount is larger than a predetermined amount is output from the loop detection sensor 112, the control board 100 rotates the fixing motor M at a predetermined high speed to reduce the loop amount. When a signal indicating that the sheet loop amount is smaller than a predetermined amount is output from the loop detection sensor 112, the control board 100 rotates the fixing motor M at a predetermined low speed to increase the loop amount. In this way, based on the signal from the loop detection sensor 112, the control board 100 controls the operation related to the sheet conveyance of a fixing drive roller 42 of the fixing device 40 so that the sheet loop amount becomes a predetermined amount.

In the present exemplary embodiment, as illustrated in FIG. 3A, the sheet contact portion 111*a* of the sensor lever 111 is arranged so as to contact the non-image surface of the sheet P. The non-image surface as referred to here means the sheet surface on the opposite side of the surface to which the toner image has been transferred from the intermediate transfer belt 61. That is, the sensor lever 111 is rotatably mounted on the movable unit (holder) 94 of the opening/closing door 92 opening the conveyance path 36*a* (See FIG. 2). The sensor lever 111 is held in contact with the non-image surface of the sheet P for the following reason. That is, if the sheet contact portion 111*a* of the sensor lever 111 comes into contact with the image surface of the sheet P, the sensor lever 111 will come into contact with the toner image that has not undergone fixing yet, resulting in a defective image. The loop detection sensor 112 generating a signal corresponding to the position of the sensor lever 111 is mounted not on the opening/closing door 92 but to the apparatus main body 1 (See FIG. 2). Like the sensor lever 111, the conveyance guide 36 is also arranged so as to come into contact with the non-image surface of the sheet.

As described above, when the opening/closing door 92 is closed, the positioning protrusion 96 is engaged with the positioning hole portion 97 as a positioning portion, and the abutment portion 98 abuts the abutment portion 99 as a positioning portion, whereby the movable unit 94 is set in position with respect to the apparatus main body 1. That is, the movable unit 94 is set in position with respect to the apparatus main body 1 without being affected by play at the hinge shaft 92*a* between the apparatus main body 1 and the door main body 93 or deflection of the door main body 93. The sensor lever 111 is rotatably supported by the movable unit 94 set in position with respect to the apparatus main body 1, so that it is possible to attain a high level of accuracy in the positional relationship between the apparatus main body 1 and the sensor lever 111. Thus, it is possible to detect a sheet loop with high accuracy.

The fixing motor M for driving the fixing device 40 is mounted on the apparatus main body 1. Further, the apparatus main body 1 is provided with a control board 100 for controlling the driving of the fixing motor M, and a line bundle 113 for connecting the loop detection sensor 112 and the control board 100 (See FIG. 3B).

As illustrated in FIG. 4, the loop detection sensor 112 mounted on the apparatus main body 1 is fixed to a main body frame 130 of the apparatus main body 1. The main body frame 130 is formed of metal to enhance the strength of the apparatus main body 1.

The light shielding portion 111*b* of the sensor lever 111 is arranged so as to overlap the conveyance path 36*a* and the conveyance guide 36 as seen in the X-direction in FIGS. 4 and 5 (as seen from the direction along the Y-direction). As seen in the YZ-plane in FIGS. 4, 5A, and 5B, the light shielding portion 111*b* of the sensor lever 111 is provided in the non-sheet-passing region E of the sheet P (outside the conveyance region) as illustrated in FIG. 5B.

The loop detection sensor 112 is mounted on the apparatus main body 1, and is connected to the control board 100 by the line bundle 113. As illustrated in FIGS. 5A and 5B, both the loop detection sensor 112 and the control board 100 are arranged on the rear surface side of the apparatus main body 1 with respect to the sheet-passing region.

As described above, in the present exemplary embodiment, the loop detection sensor 112, the control board 100, and the line bundle 113 are all mounted on the apparatus main body 1. Thus, it is possible to easily effect electrical connection between the loop detection sensor 112 and the control board 100. In other word, it is possible to mount the line bundle 113 on the apparatus main body 1 independently of the opening/closing door 92 that can be opened and closed, so that it is possible to attain a satisfactory workability in terms of the mounting of the line bundle 113. Further, in the present exemplary embodiment, the loop detection sensor 112 is arranged outside the sheet passing region and on the same side as the control board in the sheet width direction crossing the sheet conveyance direction. Thus, the length of the line bundle 113 may be relatively short.

In the present exemplary embodiment, the loop detection sensor 112 is mounted on the main body frame 130 formed of metal. Due to this configuration, when the user brings his finger close to the loop detection sensor 112 to handle jamming, the electric current from the user's finger, which is charged, flows toward the main body frame 130 formed of metal. Thus, there is no fear of breakage of the loop detection sensor 112 due to the user's finger, which is charged.

<Mounting the Loop Detection Sensor>

FIG. 6 is an explanatory view illustrating mounting relationship of the loop detection sensor 112 with respect to the transfer unit (62, 35) and the fixing device 40.

A transfer unit 6 supporting the transfer drive roller 62 is supported on the main body frame 130 by a transfer positioning portion 69. The fixing device 40 is provided with a fixing drive roller 42 for nip-conveying the sheet P. The fixing device 40 is supported on the main body frame 130 by a fixing positioning portion 49.

Both ends of the sheet loop formed between the transfer unit (62, 35) and the fixing nip of the fixing device 40 are determined by the position of the transfer drive roller 62 determining the position of the transfer unit, and by the position of the fixing drive roller 42 determining the fixing nip position. To form a stable sheet loop between the transfer nip and the fixing nip, it is desirable to arrange the loop detection sensor 112 away from the transfer drive roller 62 and the fixing drive roller 42 respectively via a small number of components. That is because the rotation of the fixing drive roller 42 is controlled in response to the signal from the loop detection sensor 112. Thus, as the number of components between the loop detection sensor 112 and the transfer drive roller 62 and between the loop detection sensor 112 and the fixing drive roller 42 are smaller, the influence of the variation in component precision becomes less.

In the present exemplary embodiment, the components existing between the loop detection sensor 112 and the transfer drive roller 62 are the main body frame 130, the transfer unit 6, and the transfer drive roller 62. The components existing between the loop detection sensor 112 and the fixing drive roller 42 are the main body frame 130 and the fixing drive roller 42 (fixing device 40). Thus, the loop detection sensor 112 is arranged away from the transfer drive roller 62 and the fixing drive roller 42 respectively via a small number of components, so that the loop formation is stabilized.

<Configuration of the Sensor Lever 111>

FIGS. 7A, 7B, and 7C are explanatory views illustrating in detail the configuration of the sensor lever 111. FIG. 7A is a sectional view illustrating a state in which the rotation of the sensor lever is regulated, and the sensor lever is being at rest. FIG. 7B is a sectional view illustrating the position of the sensor lever 111 when loop control is performed, with the sensor lever having been pushed by the conveyed sheet to rotate clockwise from the position of FIG. 7A. FIG. 7C is a perspective view illustrating a state in which the rotation of the sensor lever 111 is regulated and the sensor lever is being on standby.

As illustrated in FIG. 7C, a slit 36*b* is formed at a position of the conveyance guide 36 corresponding to the sheet contact portion 111*a* of the sensor lever 111. The sheet contact portion 111*a* of the sensor lever 111 protrudes into the conveyance path 36*a* via the slit 36*b*. A slit 36*c* is formed at a position of the conveyance guide 36 corresponding to the light shielding portion 111*b* of the sensor lever 111. The light shielding portion 111*b* extends through the slit 36*c* to a position where it is opposite the loop detection sensor 112.

In FIG. 7A, a first regulating portion 300 contacting the sheet contact portion 111*a* and a second regulating portion 302 contacting the light shielding portion 111*b* regulate the sensor lever 111, which strives to rotate in the direction C by its own weight (See FIG. 7C). In the present exemplary embodiment, the first rotation regulating portion 300 is an edge of the slit 36*b* formed in the conveyance guide 36, and, in the present exemplary embodiment, the second rotation regulating portion 302 is an edge of the slit 36*c* formed in the conveyance guide 36.

The sheet contact portion 111*a* and the light shielding portion 111*b* protrude toward the apparatus main body 1 side from a rotation shaft 111*c* of the sensor lever 111. Not only the sheet contact portion 111*a* but also the light shielding portion 111*b* functions as a weight for rotating the sensor lever 111 in a direction (direction C) opposite to the direction in which it rotates when pushed by the sheet. In other words, the sensor lever 111 obtains, due to its own weight, a moment in the direction in which the sheet contact portion 111*a* comes into contact with the sheet P, i.e., in the direction (indicated by the arrow C) in which the sheet contact portion 111*a* falls vertically downwards around the rotation shaft 111*c*.

<Comparison With a Comparative Example>

FIGS. 13A and 13B through 15 are diagrams illustrating an image forming apparatus according to a comparative example in which a loop detection sensor is provided on the opening/closing door 92.

Figure 13A:
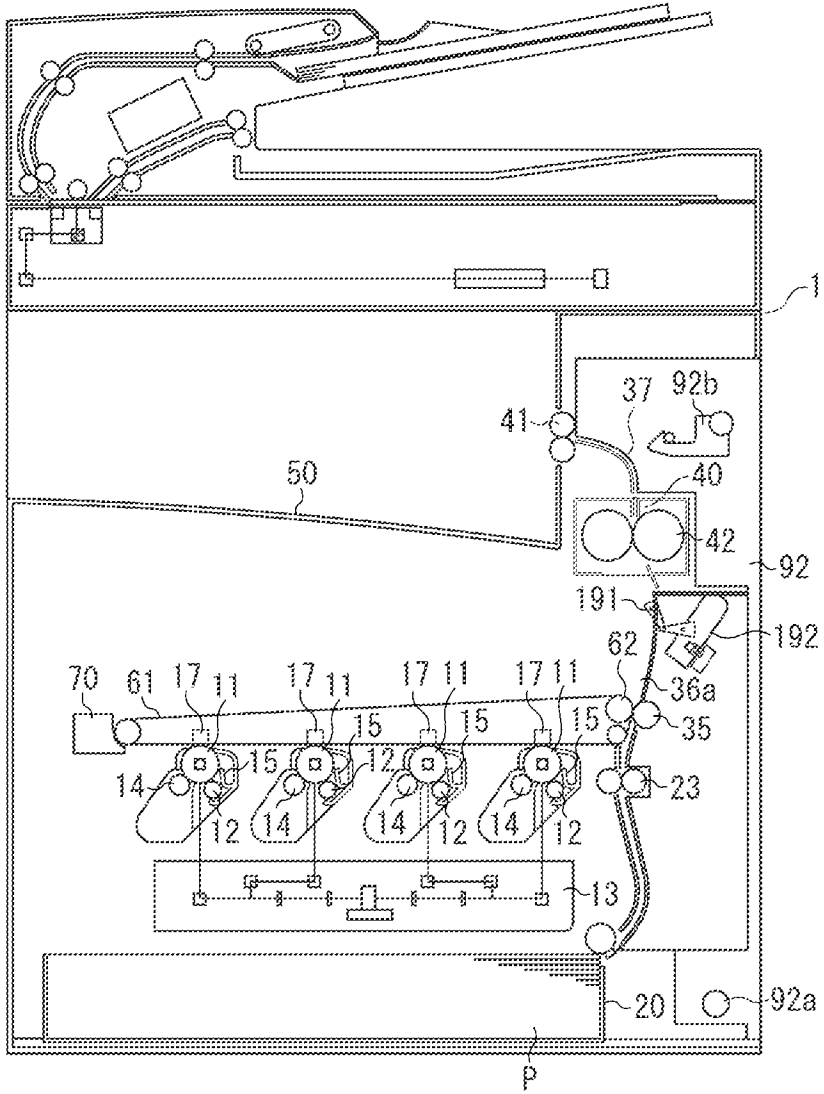
FIGS. 13A and 13B are explanatory views illustrating a construction of a comparative example.
Figure 13B:
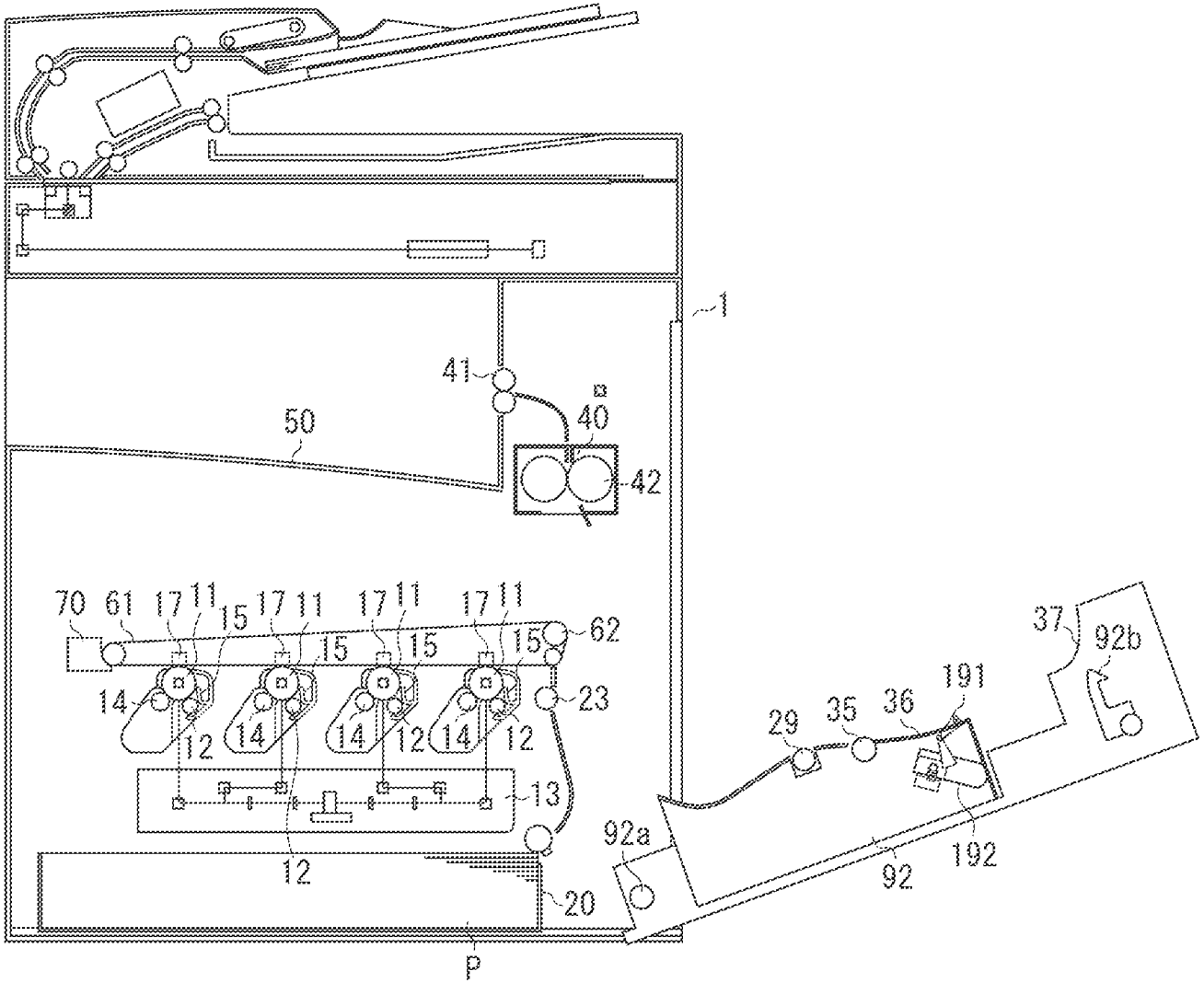
Figure 14:
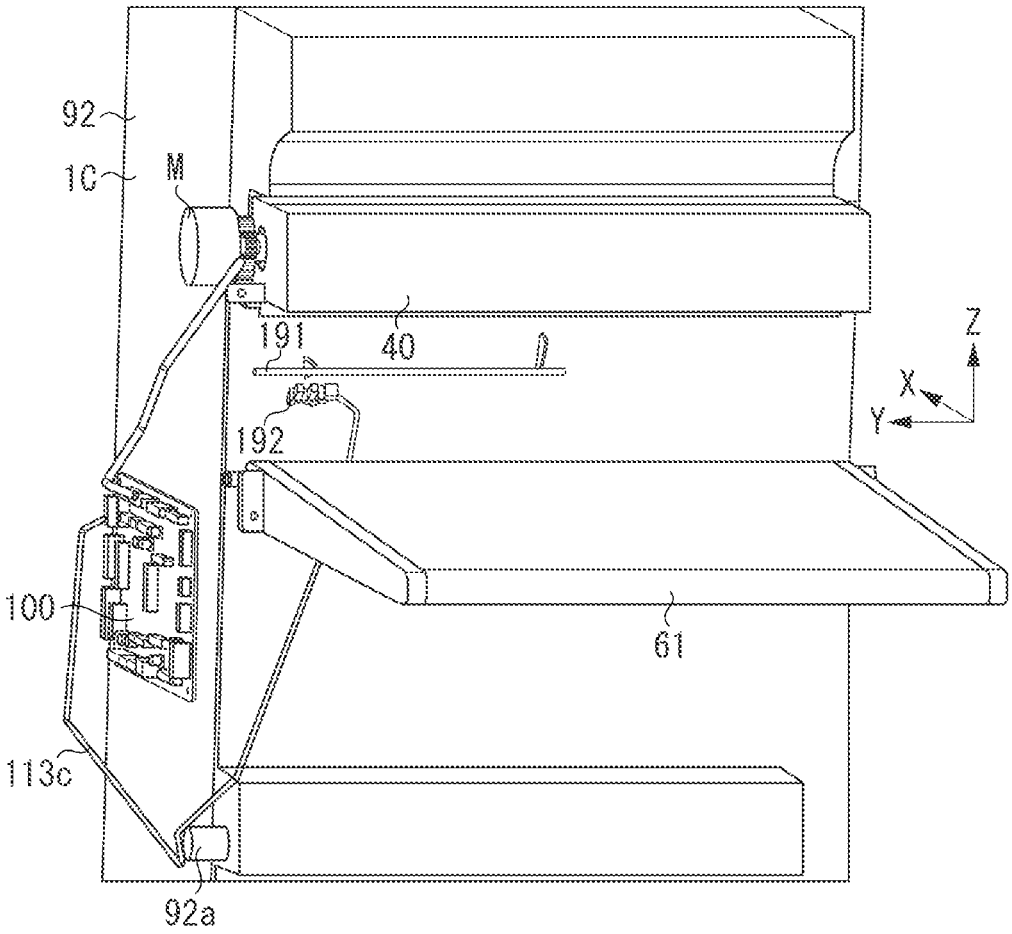
FIG. 14 is a perspective view of an image forming apparatus according to the comparative example.

FIG. 13A illustrates the image forming apparatus according to the comparative example in a state in which the opening/closing door is closed, and FIG. 13B illustrates the image forming apparatus according to the comparative example in a state in which the opening/closing door is open. FIG. 14 is an explanatory view illustrating the arrangement of a line bundle from a sheet detection sensor in the construction of the comparative example. In FIGS. 13A and 13B through 15, the components that are of the same configuration as those of the first exemplary embodiment are indicated by the same reference numerals, and descriptions thereof are not repeated.

As illustrated in FIG. 14, in the comparative example where the loop detection sensor 192 is attached to the opening/closing door 92, the line bundle 113*c* from the loop detection sensor 192 is routed around a hinge shaft 92*a* of the opening/closing door 92, and is connected to the control board 100 inside the apparatus main body 1C. Thus, the workability in mounting the line bundle 113*c* is rather unsatisfactory. Further, to secure the arrangement space for the line bundle, an increase in the size of the apparatus is involved. Further, the operational force of the opening/closing door 92 around the hinge shaft 92*a* increases due to the elastic force of the line bundle.

As compared with the configuration of this comparative example, as illustrated in FIG. 5, in the present exemplary embodiment, the line bundle 113 connected to the loop detection sensor 112 is connected to the control board 100 without being routed around the hinge shaft 92*a* of the opening/closing door 92. Thus, the workability when mounting the line bundle is more satisfactory than that in the comparative example. Further, it is possible to solve the problems involved in the configuration of the comparative example, i.e., the increase in size of the apparatus due to the routing of the line bundle 113 of the loop detection sensor 112 and the increase in heaviness of the operational force.

To reduce the requisite operational force when opening/closing the opening/closing door 92, the opening/closing door 92 is formed of resin, which is light in weight. In the comparative example, the loop detection sensor 112 is mounted on the opening/closing door 92 formed of resin. Thus, in the comparative example, it is necessary to provide a dedicated metal component for preventing breakage of the loop detection sensor 192 due to electric discharge to the loop detection sensor 192 from the user's finger charged at the time of opening the opening/closing door 92. Therefore, a dedicated anti-static-electricity component formed of metal is provided around the loop detection sensor 192. And, it is also necessary to provide a configuration allowing the discharge current to be grounded via the anti-static-electricity component.

In contrast, as described above, in the present exemplary embodiment, the loop detection sensor 112 is mounted on the metal main body frame 130 constituting the apparatus main body 1. Thus, the electric current from the user's finger which is electrically charged flows to the metal main body frame 130. Thus, there is no need to provide a dedicated anti-static-electricity component as described in connection with the comparative example.

Further, in the configuration of the comparative example, the components existing between the loop detection sensor 192 and the transfer drive roller 62 are the opening/closing door 92, the hinge shaft 92*a*, the main body frame 130, the transfer unit 6, and the transfer drive roller 62, which means a rather large number of components. The components existing between the loop detection sensor 192 and the fixing drive roller 42 are the opening/closing door 92, the hinge shaft 92*a*, the main body frame 130, and the fixing drive roller 42 (fixing device 40), which means a rather large number of components. Thus, the amount of the loop formed in the sheet is not stable.

As described above, in the present exemplary embodiment, the number of components existing between the transfer drive roller 62 and the loop detection sensor 112, and the number of components existing between the fixing drive roller 42 and the loop detection sensor 112 are both smaller than those in the comparative example. Thus, the formed loop is more stable than in the comparative example.

Figure 15:
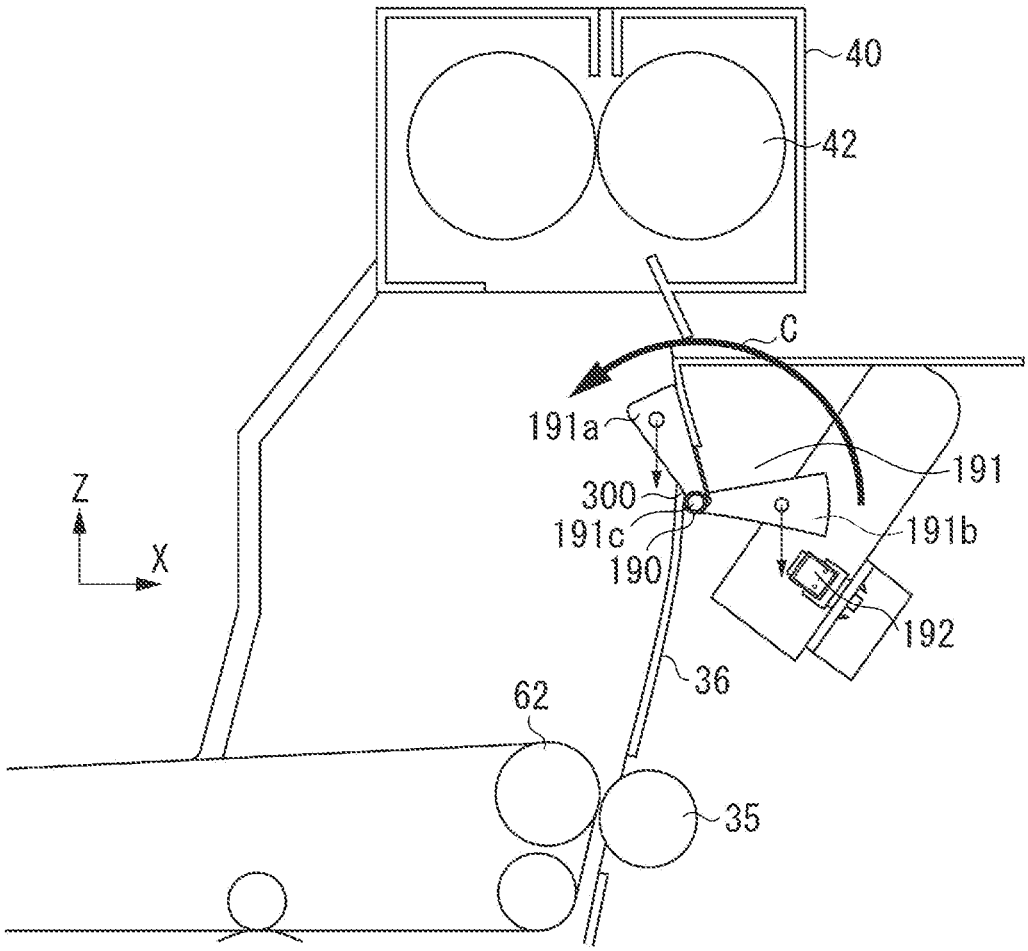
FIG. 15 is an explanatory view illustrating a construction of a sensor lever according to the comparative example.

FIG. 15 is an explanatory view illustrating a configuration of a loop detection lever 191 according to a comparative example.

In the comparative example, the loop detection lever 191 is composed of a rotation shaft 191*c*, a sheet contact portion 191*a* configured to come into contact with the sheet P, and a light shielding portion 191*b* to be detected by a loop detection sensor 192. The loop detection lever 191 is provided with a dedicated spring 190 for generating a rotational moment in the direction of the arrow C.

However, as described above with reference to FIGS. 7A and 7B, in the present exemplary embodiment, not only the sheet contact portion 111*a* but also the light shielding portion 111*b* protruding toward the apparatus main body 1 is caused to function as weights, causing a moment in the direction of the arrow C by virtue of their own weight. Thus, there is no need to provide the dedicated spring 190 for urging the loop detection lever 191.

Further, in the configuration of the comparative example, to hold the loop detection lever 191 at a predetermined standby position, the rotation is regulated solely through contact with the sheet contact portion 191*a*. In the configuration of the comparative example, when the diameter of the rotation shaft 191*c* of the loop detection lever 191 is reduced to achieve a reduction in weight, there is a fear of the following problem. That is, the loop detection lever 191*a* is left for a long period of time, with the sheet contact portion 191*a* being held in contact with a regulating portion. Then, due to the synergistic effect of the weight of the light shielding portion 191*b* and of the heat of the fixing device 40 arranged in the vicinity, the rotation shaft 191*c* undergoes torsion due to creep deformation. Thus, it is impossible to detect the loop of the sheet P at the correct position, so that there is a fear of an image defect.

As described above with reference to FIGS. 7A, 7B, and 7C, in the present exemplary embodiment, there is provided not only the first rotation regulating portion 300 configured to come into contact with the sheet contact portion 111*a*, but also the second rotation regulating portion 302 configured to regulate the weight of the light shielding portion 111*b*. Thus, the rotation shaft 111*c* undergoes no torsion due to the weight of the light shielding portion 111*b*, so that it is also possible to reduce the size of the rotation shaft 111*c* of the sensor lever 111 to attain a reduction in weight.

An image forming apparatus according to a second exemplary embodiment of the present invention will be described. The second exemplary embodiment differs from the first exemplary embodiment in that there is provided not a loop detection unit but a sheet detection unit configured to detect a sheet after fixing. The components common to the first and second exemplary embodiments are indicated by the same reference numerals, and the descriptions thereof will be omitted.

Figure 8A:
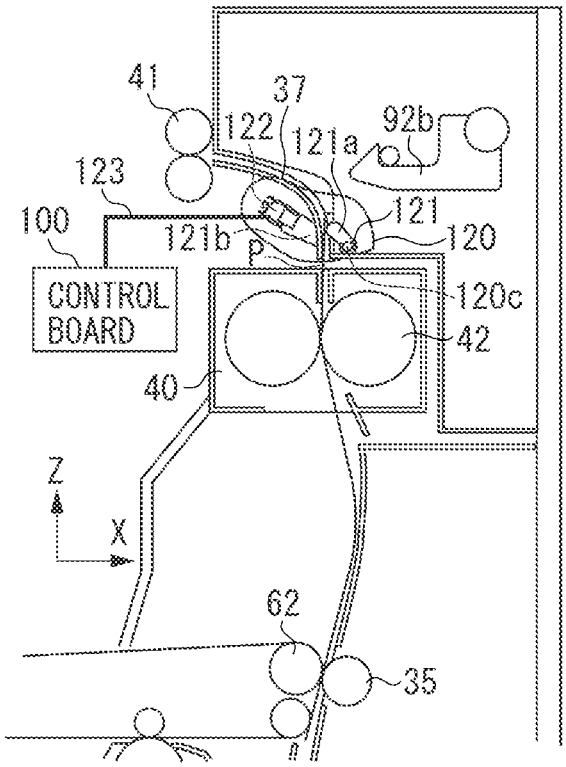
FIGS. 8A and 8B are explanatory views illustrating a post-fixing conveyance detection unit according to a second exemplary embodiment.
Figure 8B:
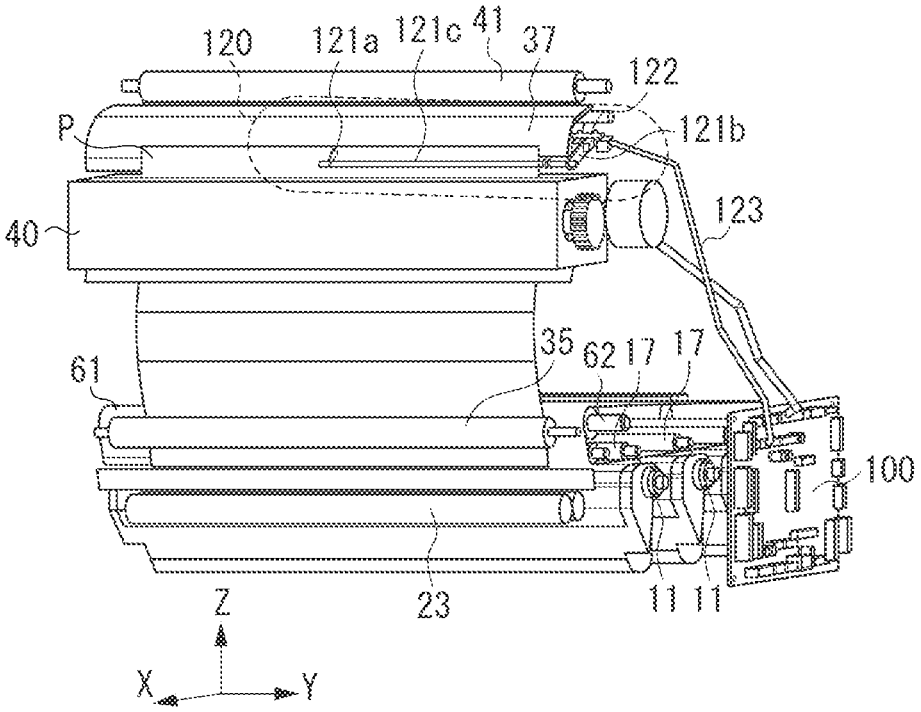

FIGS. 8A and 8B through 12A, 12B, and 12C are explanatory views illustrating the sheet detection unit configured to detect a sheet on the downstream side of the fixing device 40. FIG. 8A is a front sectional view of the image forming apparatus, and FIG. 8B is a perspective view of the same as seen from the rear side. FIG. 9A is a sectional view illustrating a state in which the opening/closing door is closed, and FIG. 9B is a diagram illustrating a state in which the opening/closing door 92 is open.

Figure 10:
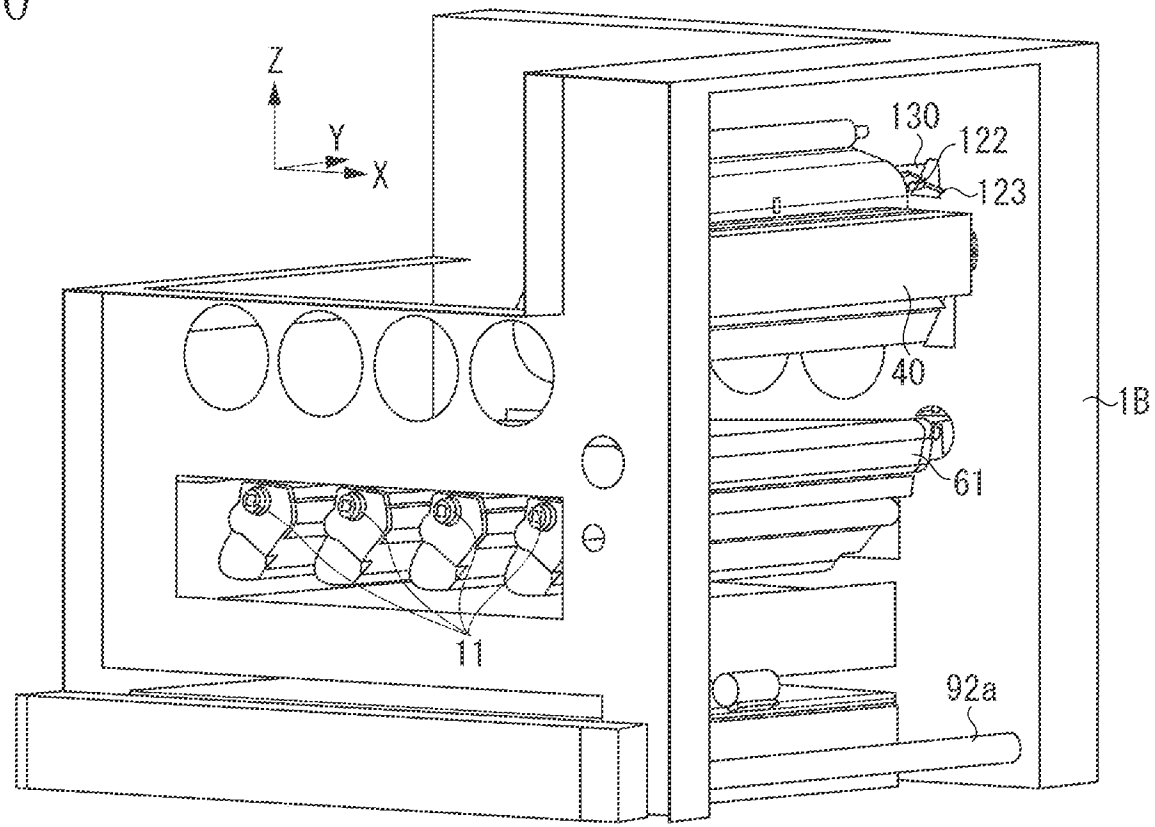
FIG. 10 is an explanatory view of a sheet detection sensor according to the second exemplary embodiment.
Figure 11A:
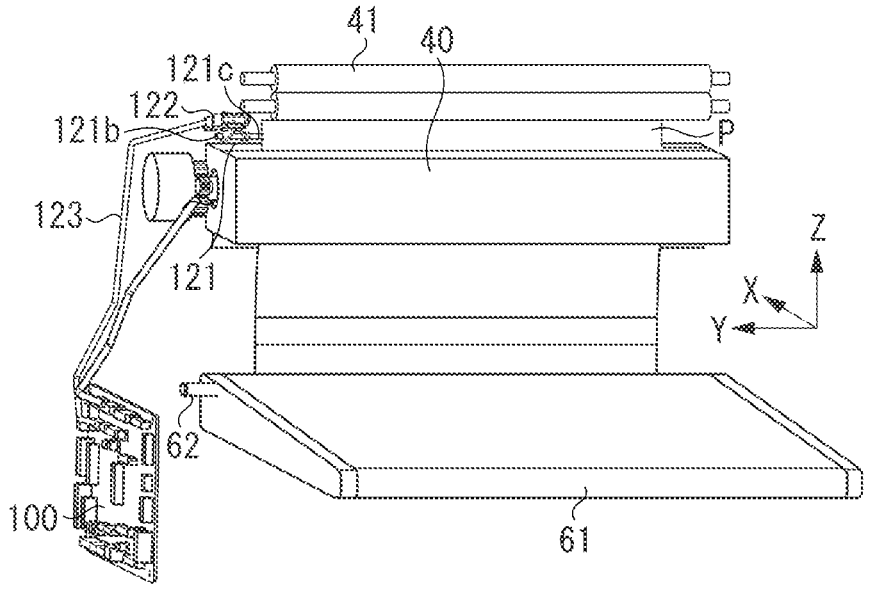
FIGS. 11A and 11B are explanatory views of the sheet detection sensor according to the second exemplary embodiment.
Figure 11B:
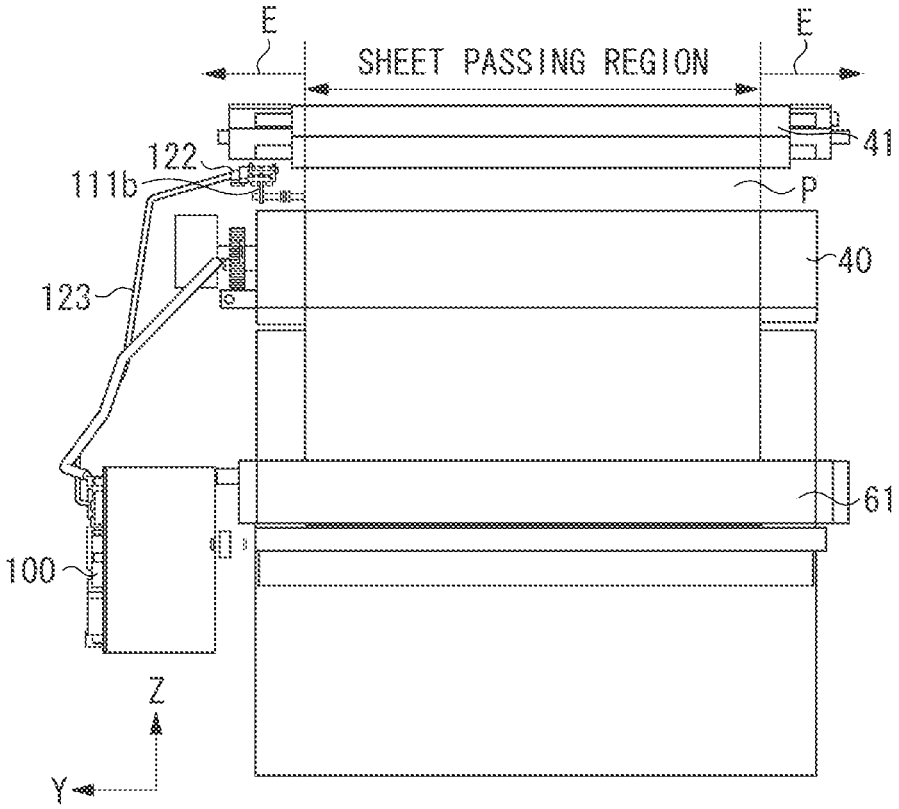

FIG. 10 is a perspective view of the image forming apparatus as seen obliquely from the front right side, illustrating a part thereof on the main body side. FIG. 11A is a perspective view of the image forming apparatus as seen obliquely from the rear left side, illustrating the positional relationship of the sheet detection unit of the image forming apparatus. FIG. 11B is a side view of the sheet detection sensor as seen from the sheet conveyance direction and the vertical direction. FIG. 12 is an explanatory view illustrating in detail the configuration of the sensor lever.

Figure 12A:
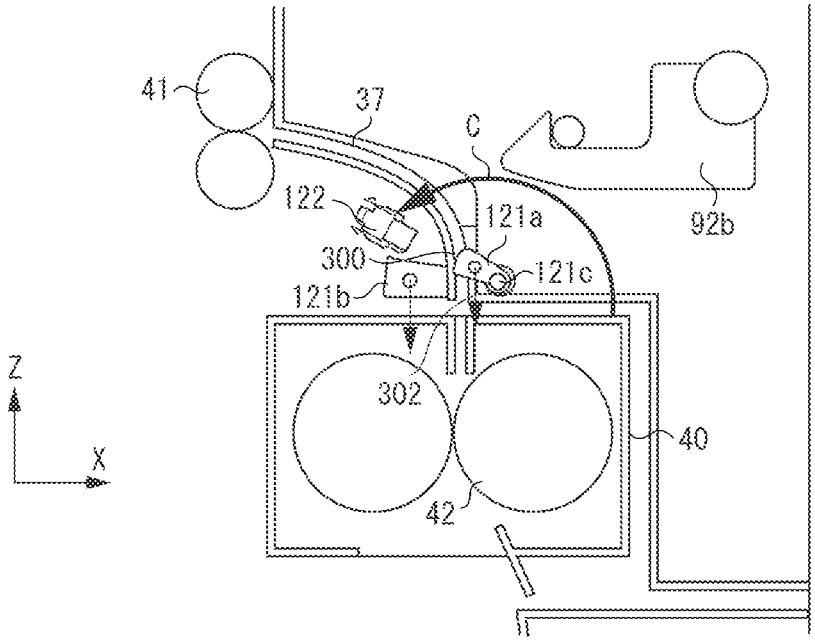
FIGS. 12A, 12B, and 12C are explanatory views illustrating a configuration of a sensor lever according to the second exemplary embodiment.
Figure 12B:
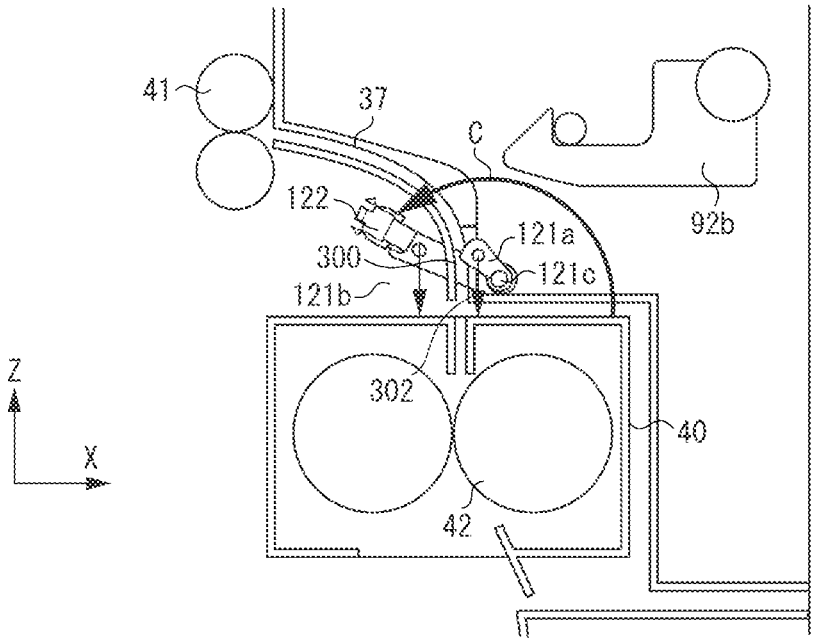
Figure 12C:
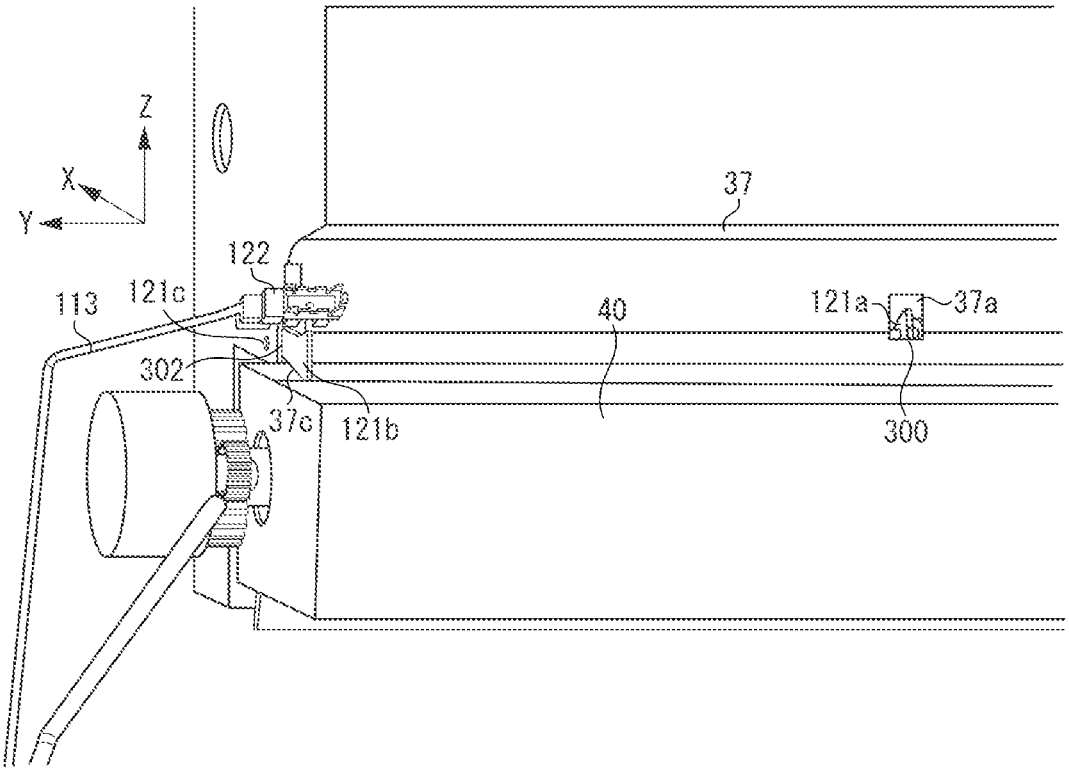

FIG. 12A is a sectional view illustrating a state in which the rotation of the sensor lever is regulated, and the sensor lever is being at rest. FIG. 12B is a sectional view illustrating the position of the sensor lever when it is detecting a sheet. FIG. 12C is a perspective view illustrating a state in which the rotation of the sensor lever is regulated, and the sensor lever is being at rest.

As illustrated in FIG. 8A, a post-fixing conveyance path 37*a* between the fixing device 40 and a discharge roller pair 41 is equipped with a sheet detection unit 120 for detecting a sheet.

Figure 9A:
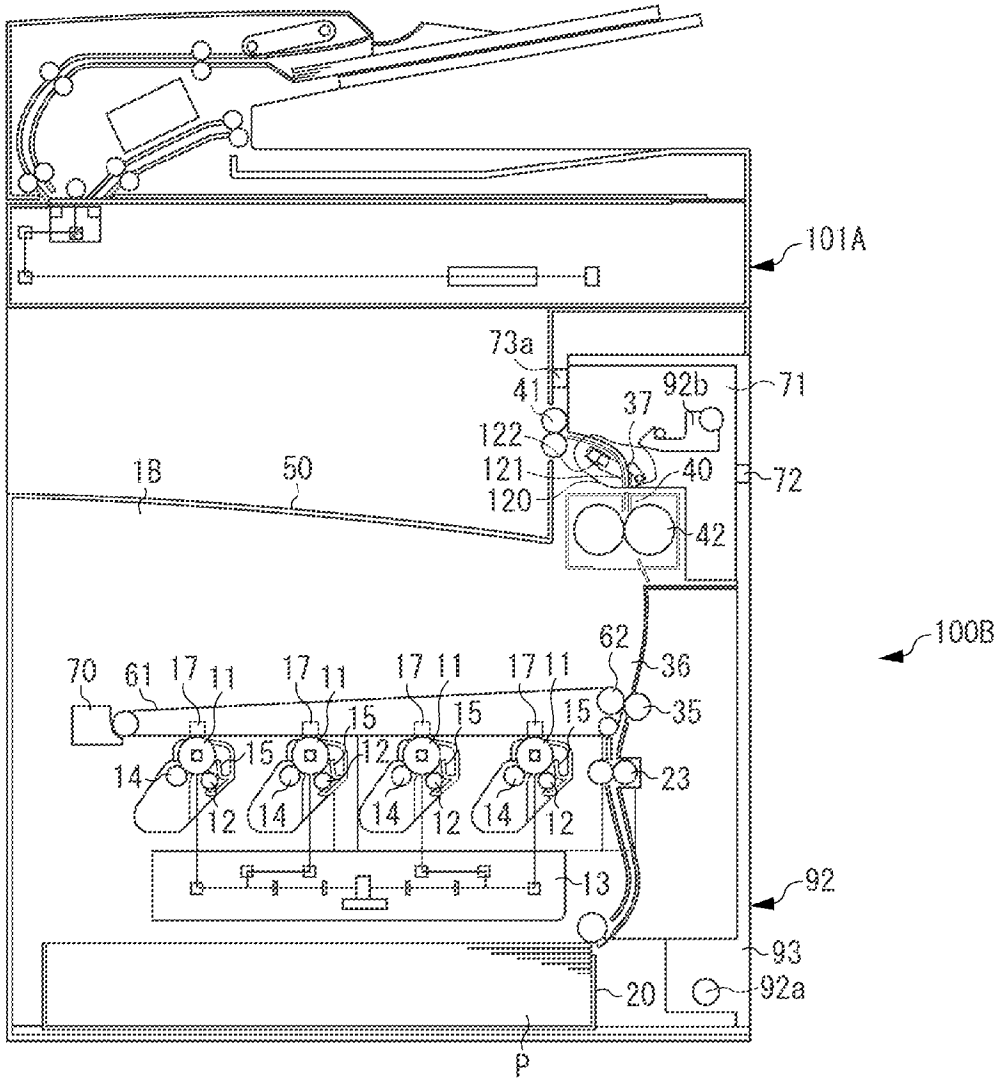
FIGS. 9A and 9B are explanatory views illustrating a configuration of an opening/closing door according to the second exemplary embodiment.
Figure 9B:
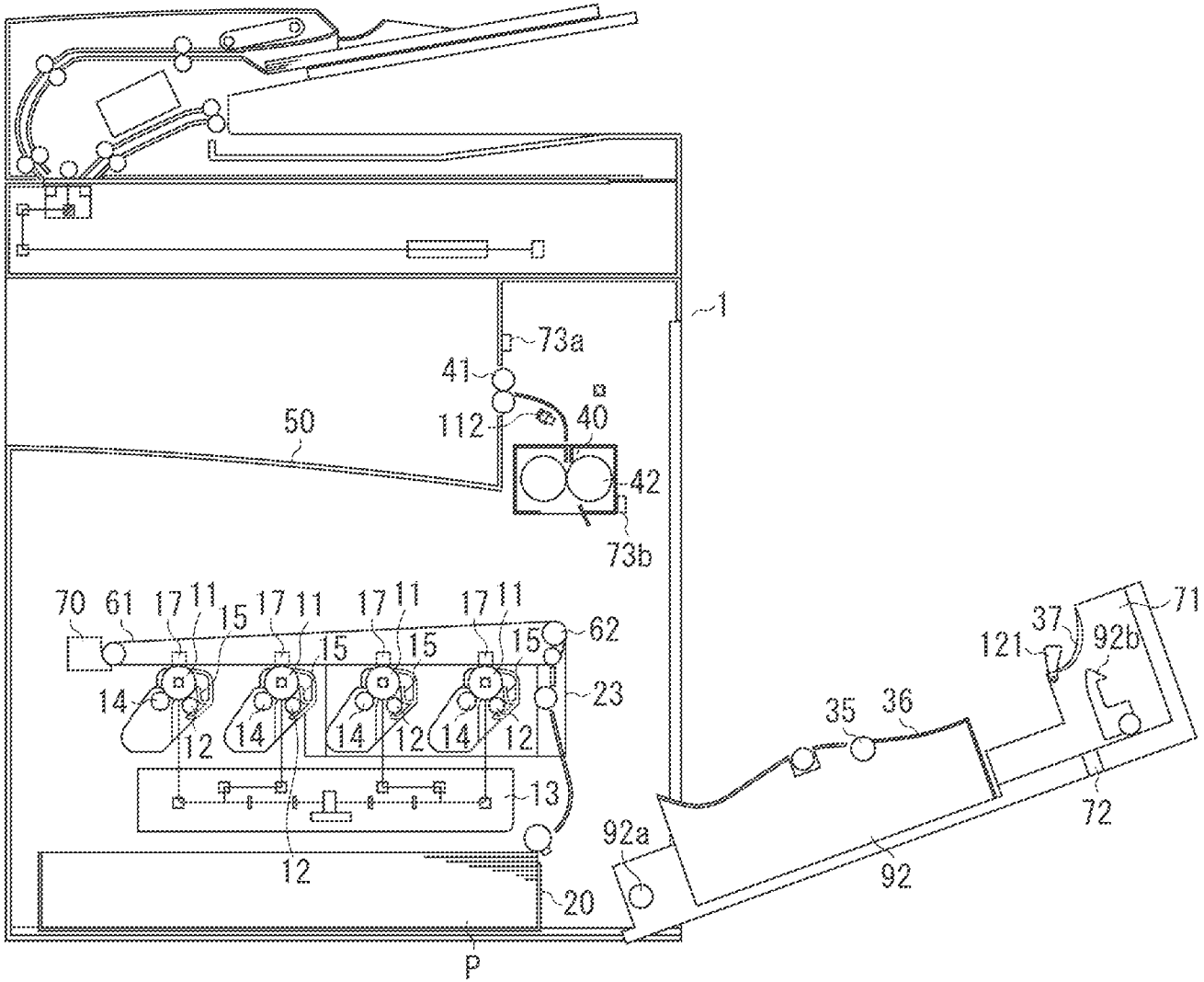

As illustrated in FIGS. 9A and 9B, the opening/closing door 92 includes a door main body 93 rotatably supported on the apparatus main body 1 by a hinge shaft 92*a* provided on the lower portion of the printer unit 100A, and a lever holding unit 71 movably held by the door main body 93. On the upper portion of the door main body 93, there is provided a door lock portion 92*b* for locking the opening/closing door 92 in the closed position.

A compression spring 72 is provided between the lever holding unit 71 and the door main boy 93. The lever holding unit 71 is held by the door main body 93 in a floating state in which it is movable in the vertical direction, the horizontal direction, and the front-back direction. The lever holding unit 71 as a holder rotatably holds a lever 121 of the sheet detection unit 120. When the opening/closing door 92 is closed, the lever holding unit 71 comes into contact with abutment portions 73*a* and 73*b* of the apparatus main body 1 to be set in position with respect to the apparatus main body 1.

The sheet detection unit 120 is equipped with the lever 121 as the sensor lever configured to come into contact with the sheet P, and a post-fixing sensor 122 (photo interrupter) as the sheet detection sensor configured to generate a signal corresponding to the position of the lever 121.

As illustrated in FIG. 8B, which is a perspective view of the apparatus main body 1 as seen from the rear side, the lever 121 is equipped with a horizontally extending rotation shaft 121*c*. Further, the lever 121 has a sheet contact portion 121*a* radially protruding at one end of the rotation shaft 121*c* and configured to come into contact with the sheet being conveyed. Further, the lever 121 is equipped with a light shielding portion 121*b* radially protruding at the other end of the rotation shaft 121*c* and facing the post-fixing sensor 122. As in the first exemplary embodiment, the light shielding portion 121*b* intercepts the optical path of the posit-fixing sensor 122 (photo interrupter).

The sheet and the sheet contact portion 121*a* are brought into contact with each other between the fixing device 40 and the discharge roller pair 41, and the lever 121 is rotated by being pushed by the sheet. The light shielding portion 121*b* of the lever 121 operates the post-fixing sensor 122, whereby the post-fixing sensor 122 outputs a signal indicating that the sheet has been detected.

As illustrated in FIG. 8B, the apparatus main body 1B is provided with a line bundle 123 for connecting the post-fixing sensor 122 and the control board 100. The signal from the post-fixing sensor 122 is input to the control board 100 via the line bundle 123.

Based on the signal from the post-fixing sensor 122, the control board 100 performs control on the sheet conveyance system of the printer unit 100B including a fixing motor M. For example, based on the signal from the post-fixing sensor 122, the control board 100 detects that jamming has been generated at the fixing device 40, and stops the sheet conveyance in the printer unit 100B. It is determined whether jamming has been generated based, for example, on whether the post-fixing sensor 122 has detected the arrival of the sheet within a predetermined period of time after the sheet feeding from the feeding cassette 20.

As illustrated in FIG. 9A, the lever 121 is arranged so as to be brought into contact with the non-image surface of the sheet P. In the present exemplary embodiment, the non-image surface means the sheet surface on the side opposite to the surface to which toner images have been transferred from the intermediate transfer belt 61 to be fixed thereto by the fixing device 40. As illustrated in FIG. 9B, the lever 121 is rotatably mounted on the opening/closing door 92 opening the post-fixing conveyance path 37*a*. A post-fixing sensor 122 configured to generate a signal corresponding to the position of the lever 121 is mounted not on the opening/closing door 92 but on the apparatus main body 1B of the image forming apparatus.

As illustrated in FIG. 10, the post-fixing sensor 122 mounted on the apparatus main body 1B is fixed to the metal main-body frame 130 of the apparatus main body 1B.

The light shielding portion 121*b* of the lever 121 is arranged so as to overlap the post-fixing conveyance path 37*a* in the X-direction (as seen from a direction along the Y-direction) in FIGS. 10, 11A, and 11B. Thus, when seen in the YZ-plane in FIGS. 10, 11A, and 11B, the light shielding portion 121*b* of the lever 121 is provided in the non-sheet-passing region E of the sheet P (See FIG. 11B).

As described above, the lever 121, the control board 100, and the line bundle 123 are all mounted on the apparatus main body 1B. Thus, it is possible to mount the line bundle 123 independently of the opening/closing door 92, which can be opened and closed, so that, as in the first exemplary embodiment, it is possible to attain a satisfactory workability when mounting the line bundle 123.

In the second exemplary embodiment, the post-fixing sensor 122 is mounted on the main body frame 130 formed of metal. Thus, as in the case of the loop detection sensor 112 of the first exemplary embodiment described above, due to the main body frame 130 formed of metal, there is no fear of breakage of the post-fixing sensor 122 caused by the user's finger, which is electrically charged.

<Configuration of the Lever 121>

FIGS. 12A, 12B, and 12C are explanatory views illustrating the configuration of the lever 121. FIG. 12A is a sectional view illustrating a state in which the lever 121 is regulated. FIG. 12B is a sectional view illustrating the position of the lever 121 when it is pushed by a sheet, illustrating a state in which the lever is rotated clockwise from the position of FIG. 12A by being pushed by the conveyed sheet. FIG. 12C is a perspective view illustrating a state in which the lever 121 is regulated.

As illustrated in FIG. 12C, a slit 37*b* is formed at a position of the conveyance guide 37 corresponding to the sheet contact portion 121*a* of the lever 121. The sheet contact portion 121*a* of the lever 121 protrudes into the post-fixing conveyance path 37*a* via the slit 37*b*. A slit 37*c* is formed at a position of the conveyance guide 37 corresponding to the light shielding portion 121*b* of the lever 121. The light shielding portion 121*b* extends via the slit 37*c* to a position where it is opposite the post-fixing sensor 122.

In FIG. 12A, the first regulating portion 300 contacting the sheet contact portion 121*a* and the second regulating portion 302 contacting the light shielding portion 121*b* regulate the sensor lever 121, which strives to rotate in the direction C by its own weight (See FIG. 12C). In the second exemplary embodiment, the first rotation regulating portion 300 is an edge of the slit 37*b* formed in the conveyance guide 37. In the second exemplary embodiment, the second rotation regulating portion 302 is an edge of the slit 37*c* formed in the conveyance guide 37.

The sheet contact portion 121*a* and the light shielding portion 121*b* protrude toward the apparatus main body 1B side from a rotation shaft 121*c* of the lever 121. The lever 121 obtains, due to its own weight, a moment in the direction in which the sheet contact portion 121*a* comes into contact with the sheet P, i.e., in the direction (indicated by the arrow C) in which the sheet contact portion 121*a* falls vertically downwards around the rotation shaft 121*c*.

Further, there is provided a second rotation regulating portion 302 configured to come into contact with the light shielding portion 121*b* to receive the weight of the light shielding portion 121*b*. Thus, as in the case of the sensor lever 111 according to the first exemplary embodiment, there is no fear of the rotation shaft 121*c* undergoing torsion due to the weight of the light shielding portion 121*b*, so that it is possible to reduce the size of the rotation shaft of the lever 121 to attain a reduction in weight.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-257501, filed Nov. 26, 2012, which is hereby incorporated by reference herein in its entirety.

What is claimed is:

1. A sheet conveyance apparatus comprising:

an apparatus main body;

a door movably supported by a supporting portion of the apparatus main body, so as to be capable of opening a conveyance path through which a sheet is conveyed;

a rotating member mounted at a first side of the conveyance path and configured to rotate when pushed by the sheet in the conveyance path, wherein the rotating member is contact with a non-image surface of the sheet while being pushed by sheet;

a holder configured to rotatably support the rotating member, the holder being mounted on the door so that the holder can move relative to the door in a state that the door is opened;

a positioning portion provided on the apparatus main body and configured to position the holder by contacting with the holder in a state that the door is closed; and a sensor mounted on the apparatus main body at a second side of the conveyance path opposite to the first side on which the rotating member is mounted and configured to generate a signal corresponding to the position of the rotating member.

2. The sheet conveyance apparatus according to claim 1, wherein the sensor is a photo interrupter, wherein the rotating member has a rotation shaft extending in the sheet width direction crossing the sheet conveyance direction, a contact portion radially protruding from the shaft and configured to come into contact with the sheet, and a light shielding portion radially protruding from the shaft and configured to intercept an optical path of the photo interrupter, and wherein the light shielding portion is provided outside a sheet conveyance region in the width direction.

3. The sheet conveyance apparatus according to claim 2, further comprising:

a first rotation regulating portion configured to come into contact with the contact portion so as to regulate the rotation of the rotating member, and a second rotation regulating portion configured to come into contact with the light shielding portion so as to regulate the rotation of the rotating member.

4. The sheet conveyance apparatus according to claim 1, wherein the rotating member obtains, due to an own weight of the rotating member, a moment in a direction opposite to a direction in which the lever is rotated by the conveyed sheet.

5. The sheet conveyance apparatus according to claim 1, further comprising:

a first conveyance rotary member provided on the upstream of the rotating member in the sheet conveyance direction and configured to convey the sheet;

a second conveyance rotary member provided on the downstream of the rotating member in the sheet conveyance direction and configured to convey the sheet; and a control unit configured to change a conveyance speed of the first conveyance rotary member or of the second conveyance rotary member so that a sheet loop amount of the sheet between the first conveyance rotary member and the second conveyance rotary member becomes a predetermined amount, based on a signal from the sensor when the sheet is being conveyed by both the first conveyance rotary member and the second conveyance rotary member.

6. The sheet conveyance apparatus according to claim 1, further comprising:

a transfer unit provided on the upstream of the rotating member in the sheet conveyance direction and configured to transfer a toner image onto the sheet while conveying the sheet;

a fixing unit provided on the downstream of the rotating member in the sheet conveyance direction and configured to fix the toner image onto the sheet while conveying the sheet; and a control unit configured to change a conveyance speed of the fixing unit based on a signal from the sensor when the sheet is being conveyed by both the transfer unit and the fixing unit.

7. The sheet conveyance apparatus according to claim 1, further comprising:

a fixing unit configured to fix onto the sheet a toner image transferred by a transfer unit; and a roller pair configured to convey the sheet on the downstream of the fixing portion, wherein the rotating member is arranged between the fixing unit and the roller pair, and the sensor detects the sheet between the fixing unit and the roller pair.

8. The sheet conveyance apparatus according to claim 1, wherein the sensor is mounted on a main-body frame of the apparatus main body, and the main-body frame of the apparatus main body is made of metal.

9. An image forming apparatus comprising:

an image bearing member held by an apparatus main body and configured to bear a toner image;

a transfer unit configured to transfer the toner image borne by the image bearing member to a sheet;

a conveyance path through which the sheet is conveyed;

a door movably supported by a supporting portion provided in the apparatus main body so as to be capable of opening the conveyance path;

a rotating member mounted on a first side of the conveyance path configured to be rotated when pushed by the sheet and to come into contact with a non-image surface of the sheet in the conveyance path opposite to a surface of the sheet to which the toner image is transferred;

a holder configured to rotatably hold the rotating member, the holder being mounted on the door so that the holder can move relative to the door in a state that the door is opened;

a positioning portion provided on the apparatus main body and configured to position the holder by contacting with the holder in a state that the door is closed; and a sensor provided in the apparatus main body at a second side of the conveyance path opposite to the first side on which the rotating member is mounted and configured to generate a signal corresponding to the position of the rotating member.

10. The image forming apparatus according to claim 9, wherein the sensor is a photo interrupter, wherein the rotating member has a rotation shaft extending in the sheet width direction crossing the sheet conveyance direction, a contact portion radially protruding from the rotation shaft and configured to be brought into contact with the sheet, and a light shielding portion radially protruding from the rotation shaft and configured to intercept the optical path of the photo interrupter, and wherein the light shielding portion is provided outside the sheet conveyance region in the width direction.

11. The image forming apparatus according to claim 10, further comprising:

a first rotation regulating portion configured to come into contact with the contact portion so as to regulate the rotation of the rotating member; and a second rotation regulating portion configured to come into contact with the light shielding portion so as to regulate the rotation of the rotating member.

12. The image forming apparatus according to claim 9, wherein the lever obtains, due to an own weight of the rotating member, a moment in a direction opposite to the direction in which the lever is rotated by the conveyed sheet.

13. The image forming apparatus according to claim 9, further comprising:

a fixing unit configured to fix onto the sheet the toner image transferred by the transfer unit, wherein the rotating member is arranged between the transfer unit and the fixing unit, and wherein the sensor outputs a signal corresponding to the position of the rotating member configured to rotate by being pushed by the sheet held by both the transfer unit and the fixing unit, and the image forming apparatus further comprising a control unit configured to change a conveyance speed of the fixing unit based on a signal from the sensor so that a sheet loop amount of the sheet between the transfer unit and the fixing unit becomes a predetermined amount.

14. The image forming apparatus according to claim 9, further comprising:

a fixing unit configured to fix to the sheet the toner image transferred by the transfer unit and a roller pair configured to convey the sheet on the downstream of the fixing unit, and wherein the rotating member is arranged between the fixing unit and the roller pair, and the sensor detects the sheet between the fixing unit and the roller pair.

15. The image forming apparatus according to claim 9, wherein the sensor is mounted on a metal main-body frame of the apparatus main body.

16. The image forming apparatus according to claim 9, further comprising a sheet conveyance unit configured to convey the sheet through the conveyance path, and a control unit provided in the apparatus main body and configured to control operation of the sheet conveyance unit based on a signal from the sensor.

17. An image forming apparatus comprising:

a transfer unit configured to transfer a toner image onto a sheet;

a fixing unit configured to fix to the sheet the toner image transferred by the transfer unit;

a door movably supported by a supporting portion provided in an apparatus main body so as to be capable of opening a conveyance path between the transfer unit and the fixing unit;

a rotating member mounted on a first side of the conveyance path configured to rotate by being pushed by the sheet, wherein the rotating member is contact with a non-image surface of the sheet while being pushed by sheet;

a holder configured to rotatably hold the rotating member, the holder being mounted on the door so that the holder can move relative to the door in a state that the door is opened;

a positioning portion provided on the apparatus main body and configured to position the holder by contacting with the holder in a state that the door is closed;

a sensor provided in the apparatus main body at a second side of the conveyance path on which the rotating member is mounted and configured to generate a signal corresponding to the position of the rotating member; and a control unit configured to control a conveyance speed of the fixing unit based on a signal from the sensor.

18. The image forming apparatus according to claim 17, wherein the sensor is a photo interrupter, wherein the rotating member has a rotation shaft extending in the sheet width direction crossing the sheet conveyance direction, a contact portion radially protruding from the rotation shaft, and a light shielding portion radially protruding from the rotation shaft and configured to intercept an optical path of the photo interrupter, and wherein the light shielding portion is provided outside a sheet conveyance region in the width direction.

19. The sheet conveyance apparatus according to claim 1, wherein the holder is provided with a guide configured to guide a sheet being conveyed.

20. The image forming apparatus according to claim 9, wherein the holder is provided with a guide configured to guide a sheet conveyed.

* * * * *